US012385349B2

(12) United States Patent
Threadgill

(10) Patent No.: US 12,385,349 B2
(45) **Date of Patent: *Aug. 12, 2025**

(54) BLOWOUT PREVENTER WITH MULTIPLE APPLICATION RAM BLADES

(71) Applicant: Schlumberger Technology Corporation, Sugar Land, TX (US)

(72) Inventor: Micah Threadgill, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/738,135

(22) Filed: Jun. 10, 2024

(65) Prior Publication Data

US 2024/0328277 A1 Oct. 3, 2024

Related U.S. Application Data

(63) Continuation of application No. 17/604,513, filed as application No. PCT/US2020/015787 on Jan. 30, 2020, now Pat. No. 12,006,781.

(60) Provisional application No. 62/836,699, filed on Apr. 21, 2019.

(51) Int. Cl.
*E21B 33/06* (2006.01)

(52) U.S. Cl.
CPC ..... *E21B 33/063* (2013.01)

(58) Field of Classification Search
CPC ..... E21B 33/063
See application file for complete search history.

(56) References Cited

U.S. PATENT DOCUMENTS

| | | | |
|---|---|---|---|
| 998,400 | A | 7/1911 | Ruth |
| 2,090,206 | A | 8/1937 | King |
| 3,561,526 | A | 2/1971 | Meynier |
| 3,692,316 | A | 9/1972 | Bishop |
| 4,132,265 | A | 1/1979 | Williams, Jr. |
| 4,132,267 | A | 1/1979 | Jones |
| 4,347,898 | A | 9/1982 | Jones |
| 4,537,250 | A | 8/1985 | Troxell, Jr. |
| 5,400,857 | A | 3/1995 | Whitby |

(Continued)

FOREIGN PATENT DOCUMENTS

| | | |
|---|---|---|
| EP | 2484860 A2 | 8/2012 |
| EP | 2484861 A2 | 8/2012 |

(Continued)

*Primary Examiner* — Matthew R Buck
(74) *Attorney, Agent, or Firm* — Kelly C. Brewerton

(57) ABSTRACT

A blowout preventer incudes a body having a bore and first and second guideways; a first ram movably positioned relative to the first guideway and movable toward the bore, the first ram including a first blade including at least one flat side; a first blunt leading contour running parallel to a plane of the flat side along a distal end of the first blade; at least one upper inclined surface above the first blunt leading contour; and at least one lower declined surface below the first blunt leading contour, wherein the first blade is positioned and is movable above a first plane; a second ram movably positioned relative to the second guideway and movable toward the bore, the second ram including a second blade including a second blunt leading contour; and at least one lower declined surface, wherein the second blade is positioned and is movable below the first plane.

15 Claims, 34 Drawing Sheets

(56) References Cited

U.S. PATENT DOCUMENTS

| | | | | |
|---|---|---|---|---|
| 6,173,770 | B1 | 1/2001 | Morrill | |
| 7,207,382 | B2 | 4/2007 | Schaeper | |
| 7,354,026 | B2 | 4/2008 | Urrutia | |
| 7,367,396 | B2 * | 5/2008 | Springett | E21B 33/063 83/54 |
| 7,814,979 | B2 | 10/2010 | Springett | |
| 8,066,070 | B2 | 11/2011 | Springett | |
| 8,162,046 | B2 | 4/2012 | Jahnke | |
| 8,167,031 | B2 | 5/2012 | Jahnke | |
| 8,353,338 | B2 | 1/2013 | Edwards | |
| 8,424,607 | B2 | 4/2013 | Springett | |
| 8,443,879 | B2 | 5/2013 | Jahnke | |
| 8,443,880 | B1 | 5/2013 | Jahnke | |
| 8,464,785 | B2 | 6/2013 | Carbaugh et al. | |
| 8,505,870 | B2 | 8/2013 | Yadav et al. | |
| 8,567,490 | B2 | 10/2013 | Van Winkle | |
| 8,602,102 | B2 | 12/2013 | Springett et al. | |
| 8,632,047 | B2 | 1/2014 | Hall | |
| 8,720,564 | B2 | 5/2014 | Springett et al. | |
| 8,720,565 | B2 | 5/2014 | Springett et al. | |
| 8,720,567 | B2 | 5/2014 | Springett et al. | |
| 8,770,274 | B2 | 7/2014 | Van Winkle | |
| 8,800,954 | B2 | 8/2014 | Edwards | |
| 8,807,219 | B2 | 8/2014 | Springett et al. | |
| 9,022,104 | B2 | 5/2015 | Springett et al. | |
| 9,133,680 | B2 | 9/2015 | Edwards | |
| 9,644,444 | B2 * | 5/2017 | Jurena | E21B 33/062 |
| 9,732,576 | B2 | 8/2017 | Rao et al. | |
| 9,739,109 | B2 | 8/2017 | Kroesen | |
| 9,822,602 | B2 | 11/2017 | Bleck et al. | |
| 9,879,498 | B2 | 1/2018 | Holland, Jr. | |
| 10,443,336 | B2 | 10/2019 | Ellison | |
| 10,550,660 | B2 | 2/2020 | Carbaugh | |
| 12,006,781 | B2 * | 6/2024 | Threadgill | E21B 33/063 |
| 2007/0246215 | A1 | 10/2007 | Springett | |
| 2011/0226476 | A1 * | 9/2011 | Springett | E21B 33/063 251/1.1 |
| 2011/0226477 | A1 | 9/2011 | Springett | |
| 2012/0067563 | A1 * | 3/2012 | Jellison | E21B 33/063 427/205 |
| 2012/0073816 | A1 * | 3/2012 | Springett | E21B 33/062 251/1.3 |
| 2012/0193087 | A1 | 8/2012 | Hall | |
| 2012/0193556 | A1 | 8/2012 | Yadav | |
| 2013/0062540 | A1 | 3/2013 | Jurena | |
| 2013/0119283 | A1 | 5/2013 | Jahnke | |
| 2013/0153204 | A1 | 6/2013 | Carbaugh | |
| 2014/0110611 | A1 | 4/2014 | McClanahan | |
| 2016/0138356 | A1 | 5/2016 | Ellison | |
| 2016/0258238 | A1 * | 9/2016 | Vargas | E21B 33/063 |
| 2016/0298409 | A1 | 10/2016 | Kroesen et al. | |
| 2016/0312564 | A1 | 10/2016 | Holland, Jr. | |
| 2017/0058628 | A1 | 3/2017 | van Wijk | |
| 2020/0332617 | A1 | 4/2020 | Nault | |
| 2022/0213757 | A1 | 7/2022 | Threadgill | |

FOREIGN PATENT DOCUMENTS

| | | | |
|---|---|---|---|
| EP | 2535509 | A2 | 12/2012 |
| EP | 3187681 | A1 | 7/2017 |
| FR | 3105041 | A1 | 6/2021 |
| GB | 2553430 | A | 3/2018 |
| WO | 2020169714 | A1 | 8/2020 |
| WO | 2020219410 | A1 | 10/2020 |
| WO | 2020219412 | A1 | 10/2020 |

* cited by examiner

BLOWOUT PREVENTER WITH MULTIPLE APPLICATION RAM BLADES

CROSS-REFERENCE TO RELATED APPLICATION

This application is a continuation of U.S. application Ser. No. 17/604,513, filed Oct. 18, 2021, which is a National Stage entry of International Application No. PCT/US2020/015787, filed Jan. 30, 2020, which claims benefit of and priority to U.S. Provisional Application Ser. No. 62/836,699, filed Apr. 21, 2019. Each of these applications is incorporated by reference herein in its entirety.

TECHNICAL FIELD

The present disclosure relates generally to the field of drilling wells. More particularly, the invention concerns blowout preventers (BOPs) for shearing tubing string or tools and sealing wellbores.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Blowout preventers (BOPs) are used extensively throughout the oil and gas industry. Typical blowout preventers are used as a large specialized valve or similar mechanical device that seal, control, and monitor oil and gas wells. The two categories of blowout preventers that are most prevalent are ram blowout preventers and annular blowout preventers. Blowout preventer stacks frequently utilize both types, typically with at least one annular blowout preventer stacked above several ram blowout preventers. The ram units in ram blowout preventers allow for both the shearing of the drill pipe and the sealing of the blowout preventer. Typically, a blowout preventer stack may be secured to a wellhead and may provide a safe means for sealing the well in the event of a system failure.

In order to meet consumer and industrial demand for natural resources, companies invest significant amounts of time and money in finding and extracting oil, natural gas, and other subterranean resources from the earth. Particularly, once a desired subterranean resource such as oil or natural gas is discovered, drilling and production systems are employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

More particularly, wellhead assemblies often include a blowout preventer to control pressure at the top of a well and prevent flow of formation fluids through the blowout preventer. Among the various types of blowout preventers, a shear ram blowout preventer achieves pressure control through the operation of rams (operated hydraulically or electrically) capable of shearing a tubular contained within a main bore of the blowout preventer (e.g., drill pipe, a liner, or a casing string). The rams are grouped in opposing pairs and are forced together as a result of the hydraulic or electric operation. Often, the rams are driven into and out of a main bore of a blowout preventer by operating pistons coupled to the ram blocks by connecting rods.

In a typical blowout preventer, a ram bonnet assembly may be bolted to the main body using a number of high tensile bolts or studs. These bolts are required to hold the bonnet in position to enable the sealing arrangements to work effectively. Typically an elastomeric sealing element is used between the ram bonnet and the main body. There are several configurations, but essentially they are all directed to preventing a leakage bypass between the mating faces of the ram bonnet and the main body.

During normal operation, the blowout preventers may be subject to pressures up to 20,000 psi, or even higher. To be able to operate against and to contain fluids at such pressures, blowout preventers are becoming larger and stronger. Blowout preventer stacks, including related devices, 30 feet or more in height are increasingly common.

As noted above, ram-type blowout preventers may be designed and constructed for use with drill pipe or other tubulars of specified diameter. A blowout preventer stack including rams for one size of pipe may be used with pipe of a different size by changing the pipe engaging rams or parts of the rams. Also, the ram operating mechanisms in a blowout preventer are comparatively complex and require inspection and servicing before the blowout preventer is put into service at a wellhead. Such activities, when performed in a large modern blowout preventer stack, may require the presence of personnel at locations that can be hazardous, if not impractical.

A blowout preventer may be used for shearing a tubular positioned in a bore extending through the blowout preventer, as disclosed in US2016/0258238, incorporated herein by reference in its entirety. The blowout preventer includes a first shear ram movable towards the tubular, the first shear ram including a first blade, and the first blade including an outer cutting profile and an inner cutting profile. The blowout preventer further includes a second shear ram positioned opposite the first shear ram with respect to the tubular and movable towards the tubular, the second shear ram including a second blade, and the second blade including the outer cutting profile and the inner cutting profile. The outer cutting profile includes blade portions on opposite sides of the inner cutting profile, and positioned between an angle of about 120 degrees and an angle of about 140 degrees from each other.

U.S. Pat. No. 4,537,250 discloses a ram-type shearing apparatus for a wellhead having a body with a vertical bore therethrough and aligned, opposed ram guideways extending outward in the body from the bore, a ram assembly in each of the guideways, each of the ram assemblies having a ram body with a shearing blade on the face of the ram and means for moving the ram inward and outward in the guideway, the cutting edge of the upper shear blade and the face of the ram assembly below the upper shear blade being concave to support the string during shearing sufficiently to constrain the string below the upper shear blade as it is sheared to a shape suitable for receiving an overshot type of retrieving tool and to allow flow therein, the lower shear blade having at least one node extending toward the upper shear blade so that when a pipe is being sheared the node engages and penetrates the pipe prior to other shearing of the pipe to thereby reduce the force used for such shearing.

A unitary blade seal for a shearing blind ram of a ram-type blowout preventer is disclosed in U.S. Pat. No. 7,354,026.

The blade seal includes an elongate member having a generally semi-circular cross section with a curved upper surface and a lower surface. The lower surface has a pair of laterally extending sides that taper outwardly and have a metal outer cap bonded thereto. The metal outer caps form an acute angle that engages a complementary groove formed in the upper ram of the shearing blind ram assembly.

Over the past decade the drilling market has experienced an increase in governmental regulation and operational challenges that have impacted the requirements of drilling safety equipment. To meet these requirements operators and contractors have placed an increased focus on pressure controlling equipment and the enhancement of its capabilities. One such desired enhancement is the increased shear and seal capacity of shear rams.

During drilling activities contractors are limited in what they can shear based on the shear capacity of their deployed shear rams. This requires drillers to keep track of what is in front of their shear ram blades to successfully ensure a shear in the event of an emergency disconnect situation.

The increased competitive nature of the energy industry has driven the need for more efficient and capable blowout preventer designs within the drilling and completions industry.

SUMMARY

In accordance with the teachings of the present disclosure, the invention greatly enhances the shear capability of the shearing pressure control equipment (shear ram) utilized inside of drilling blow out preventers. The invention enhances the shear effectiveness of a shear ram's leading edge by reducing its contact area with an opposing pipe. The design incorporates a rounded edge terminating in two symmetric angles above and below the rounded point of contact with the pipe. This "bull nose" design allows the leading contour to dig into the pipe and impart a ripping action throughout the contact plane by placing the tubular into tension at the point of contact. Further, the symmetric angles ensure no bending is incorporated onto the blade edge as the vertical component of the reaction force of the pipe is equalized with the other symmetric angle.

According to one or more embodiments of the present disclosure, a blowout preventer for shearing, cutting, ripping, or tearing a structure positioned in a bore extending through the blowout preventer includes: a body having a bore, a first guideway, and a second guideway; a first ram movably positioned relative to the first guideway and movable toward the bore, the first ram including a first blade, the first blade including: at least one flat side; a first blunt leading contour running parallel to a plane of the at least one flat side along a distal end of the first blade; at least one upper inclined surface above the first blunt leading contour; and at least one lower declined surface below the first blunt leading contour, wherein the first blade is positioned and is movable above a first plane; a second ram movably positioned relative to the second guideway and movable toward the bore, the second ram including a second blade, the second blade including: a second blunt leading contour; and at least one lower declined surface, wherein the second blade is positioned and is movable below the first plane.

According to one or more embodiments of the present disclosure, a blowout preventer for shearing, cutting, ripping, or tearing a structure positioned in a bore extending through the blowout preventer includes: a body having a bore, a first guideway, and a second guideway; a first ram movably positioned relative to the first guideway and movable toward the bore, the first ram including a first blade, the first blade including: at least one flat side; a first blunt leading contour running parallel to a plan of the at least one flat side along a distal end of the first blade; at least one upper inclined surface above the first blunt leading contour, wherein the at least one upper inclined surface forms an angle between about 120 and 160 degrees with the at least one flat side, and at least one lower declined surface below the first blunt leading contour, wherein the at least one lower declined surface forms an angle between about 60 and 100 degrees with the at least one upper inclined surface; a second ram movably positioned relative to the second guideway and movable toward the bore, the second ram including a second blade, the second blade including: at least one flat side; a second blunt leading contour; and at least one lower declined surface, wherein the first blunt leading contour and the second blunt leading contour are vertically offset from each other by an offset distance.

BRIEF DESCRIPTION OF THE DRAWINGS

A more complete understanding of the present embodiments may be acquired by referring to the following description taken in conjunction with the accompanying drawings, in which like reference numbers indicate like features.

DETAILED DESCRIPTION

Figure 1A:
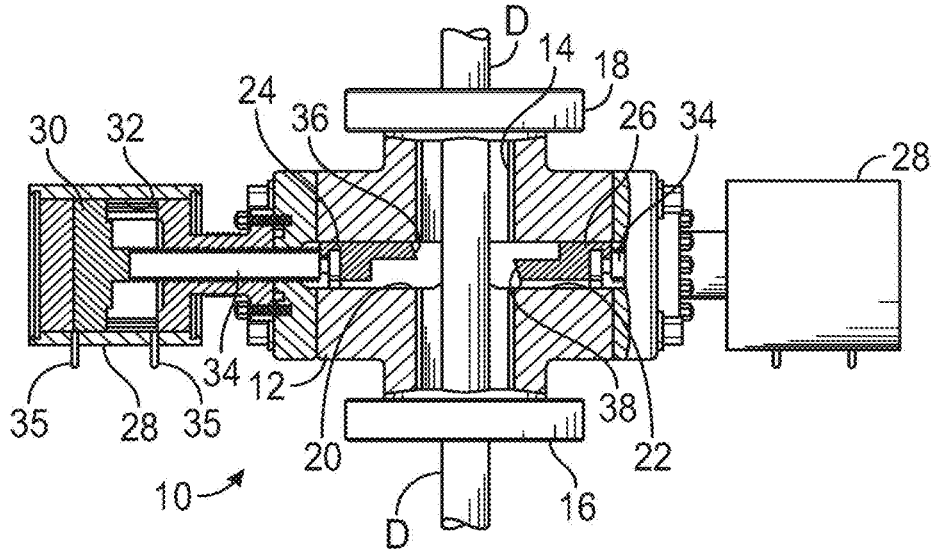
FIG. 1A illustrates a cross-sectional side view of a blowout preventer, wherein the rams are in an open position.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Preferred embodiments are best understood by reference to FIGS. 1A-10E below in view of the following general discussion. The present disclosure may be more easily understood in the context of a high level description of certain embodiments. Specific details are given in the following description to provide a thorough understanding of the embodiments. However, it will be understood by one of ordinary skill in the art that embodiments may be practiced without these specific details. For example, well-known circuits, processes, algorithms, structures, and techniques may be shown without unnecessary detail in order to avoid obscuring the embodiments.

Referring now to FIGS. 1A-IC, multiple views of a blowout preventer 10 for shearing a tubular D in accordance with one or more embodiments of the present disclosure are shown. The blowout preventer 10, which may be referred to as a ram blowout preventer, includes a body 12 with a vertical bore 14 formed and/or extending through the body 12. As shown, the body 12 may include a lower flange 16 and/or an upper flange 18, such as to facilitate connecting the blowout preventer 10 to other blowout preventers and/or other components. Cavities and/or guideways 20 and 22 may be formed within the body 12 of the blowout preventer 10, in which the guideways 20 and 22 may extend outwardly from the bore 14 and/or be formed on opposite sides of the bore 14.

The blowout preventer 10 may then include one or more ram assemblies, such as a first ram 24 and a second ram 26. The first ram 24 may be positioned and movable within the first guideway 20 and a second ram 26 positioned and movable within the second guideway 22, such as by having the first ram 24 and/or the second ram 26 movable towards and away from the tubular D. One or more actuators 28 may be provided to move the first ram 24 and/or the second ram 26, such as for moving the first ram 24 and/or the second ram 26 into the bore 14 to shear the portion of the tubular D extending through the bore 14 of the blowout preventer 10. In this embodiment, a hydraulic actuator is shown, though any type of actuator (e.g., pneumatic, electrical, mechanical) may be used in accordance with the present disclosure. As such, the actuators 28 shown in this embodiment may include a piston 30 positioned within a cylinder 32 and a rod 34 connecting the piston 30 to each respective ram 24 and 26. Further, pressurized fluid may be introduced and fluidly communicated on opposite sides of the piston 30 through ports 35, thereby enabling the actuator 28 to move the rams 24 and 26 in response to fluid pressure.

A first (e.g., upper) blade 36 (any blade according to the present disclosure) may be included with or connected to the first ram 24, and a second (e.g., lower) blade 38 (any blade according to the present disclosure) may be included with or connected to the second ram 26. The first and second blades 36 and 38 may be formed and positioned such that the second blade 38 passes below the first blade 36 in shearing of a section of a tubular D. The shearing action of first and second blades 36 and 38 may shear the tubular D. The lower portion of the tubular D may then drop into the well bore (not shown) below the blowout preventer 10, or the tubular D may hung off a lower set of rams (not shown).

Accordingly, disclosed herein are a system, blowout preventer, and/or a blade for a blowout preventer for shearing a tubular. The tubular may be positioned within the bore extending through the blowout preventer, in which the blowout preventer may be actuated to move one or more blades to engage and shear the tubular. A blade of a blowout preventer in accordance with the present disclosure may be used for shearing one or more different types of tubulars that may have different shapes, sizes, thicknesses, and other dimensions and properties. For example, a tubular may include a drill pipe joint, a casing joint, and/or a tool joint, in which a blowout preventer in accordance with the present disclosure may be used to shear each of these different types of tubulars. These tubulars may be sheared with or without replacement of any blade of the blowout preventer.

Figure 1B:
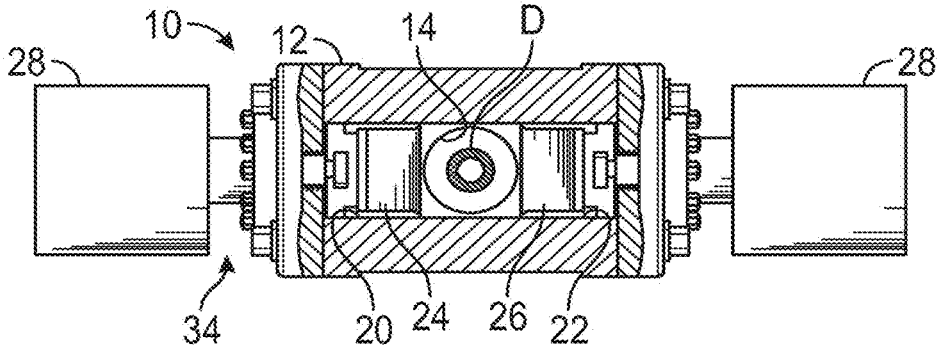
FIG. 1B shows a cross-sectional top view of the blowout preventer shown in FIG. 1A.
Figure 1C:
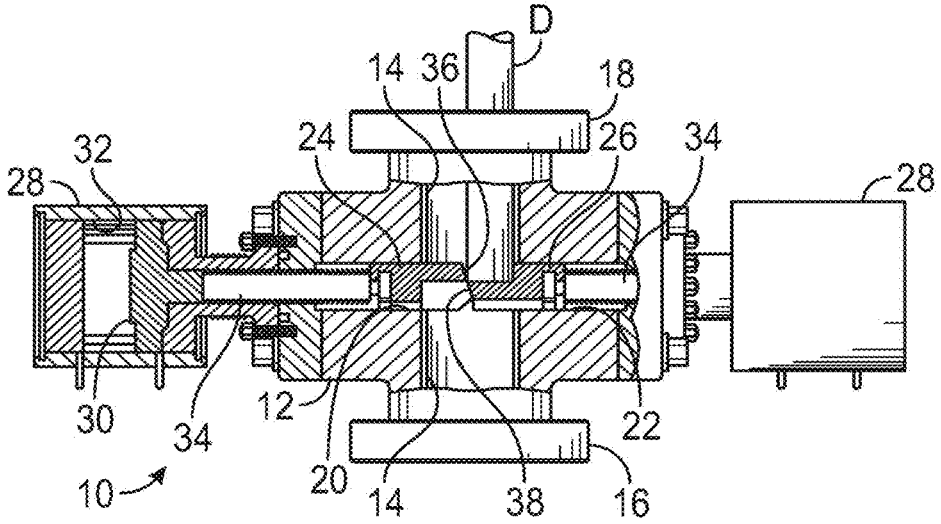
FIG. 1C illustrates a cross-sectional side view of the blowout preventer shown in FIGS. 1A-1B, wherein the rams are in a shearing or ripping position.
Figure 1D:
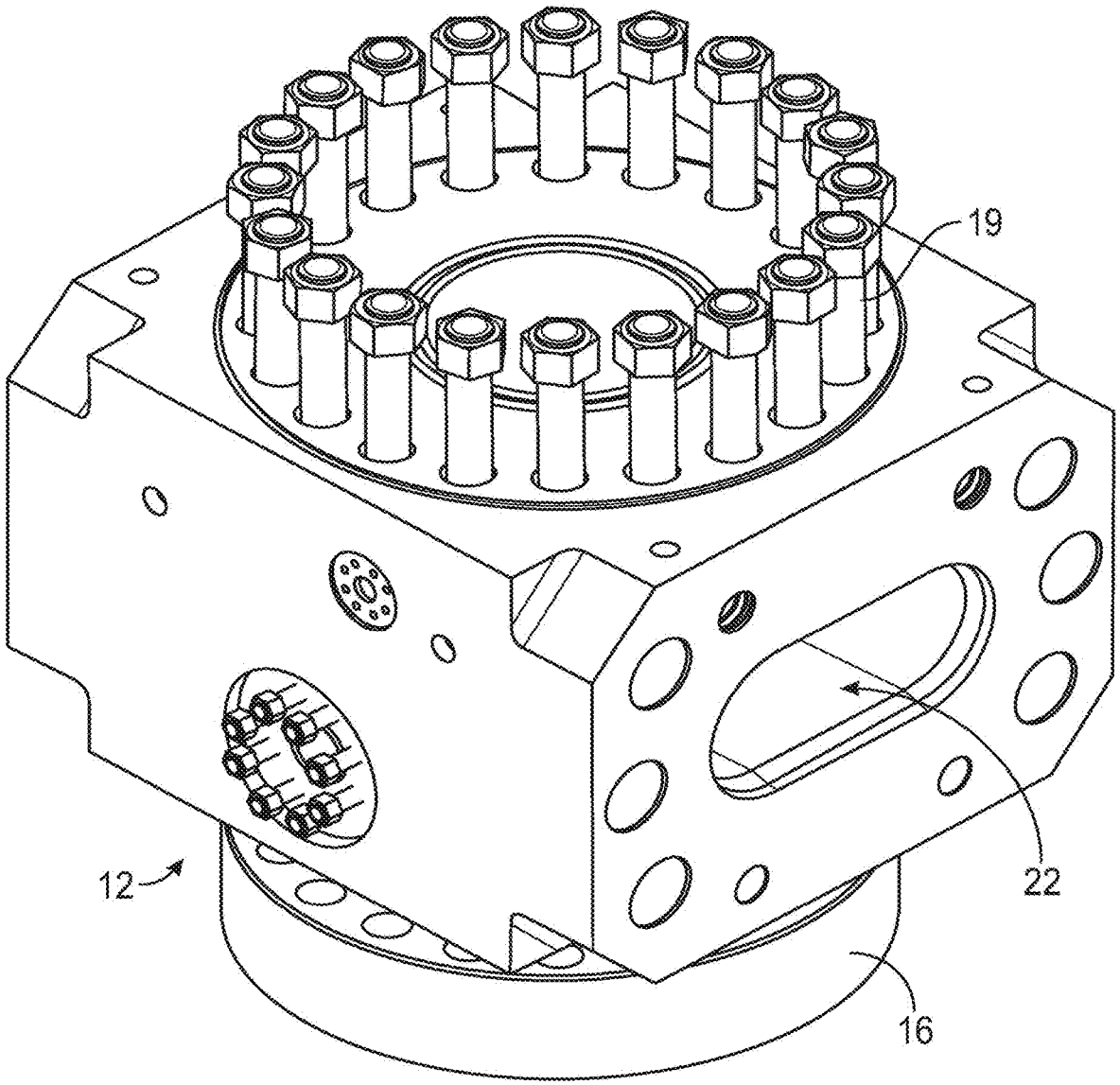
FIG. 1D shows a perspective view of a blowout preventer body.

FIG. 1D shows a perspective view of an embodiment of the body 12 of the blowout preventer 10 shown in FIGS. 1A-1C. Rather, than an upper flange 18, this embodiment has studs 19 to make up a studded connection. The guideway 22 has a cross-sectional shape that is linear on the top and the bottom and semi-circular on the left and the right sides.

Figure 2A:
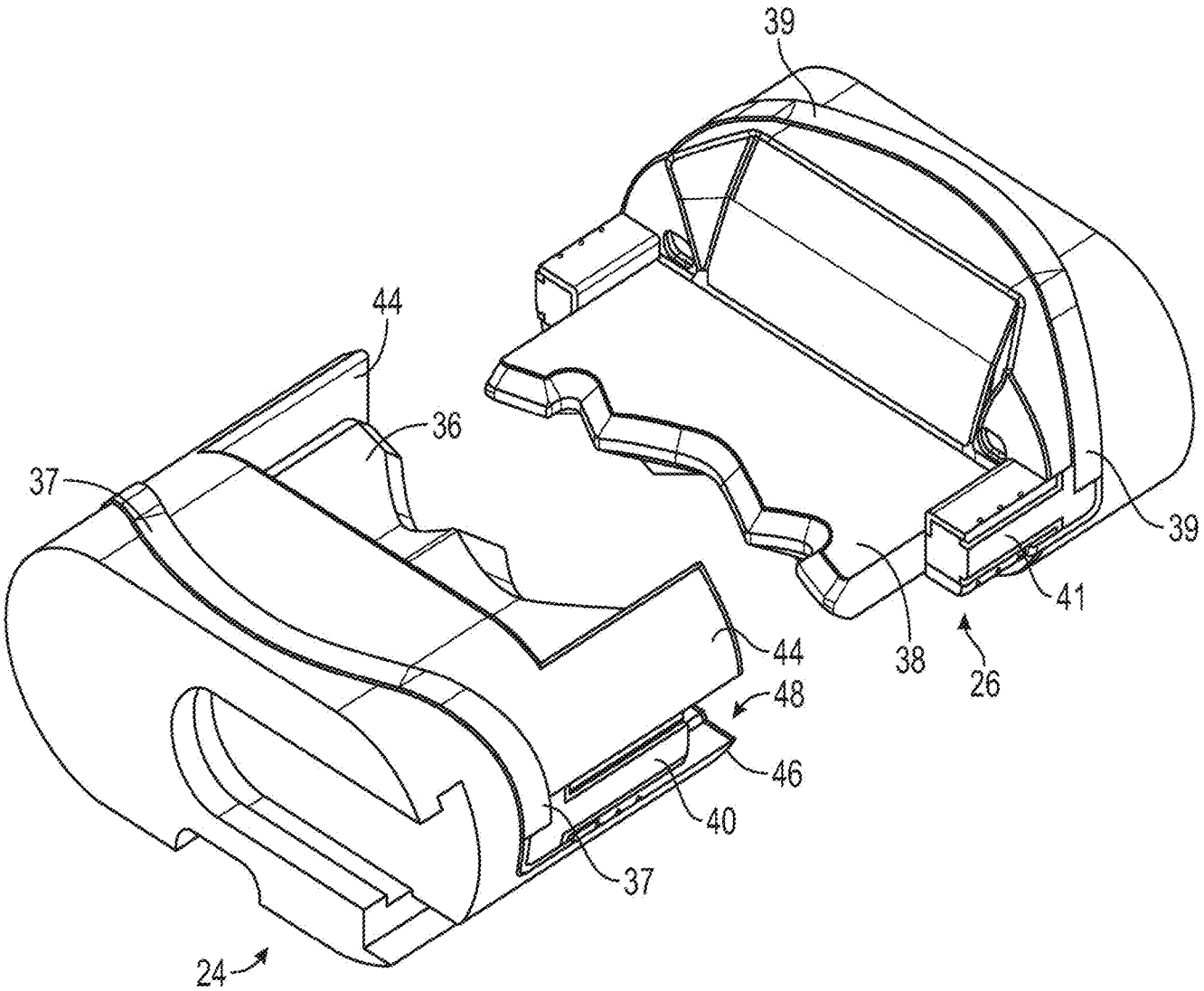
FIG. 2A illustrates perspective views of first and second rams.

Referring to FIG. 2A, a perspective view of an embodiment of a first ram 24 and a second ram 26 are shown. The rams are positioned opposite each other as they would be if positioned within the guideways 20 and 22 of the body 12 of the blowout preventer 10. The first ram 24 has a first seal 37 extending from a right side, over the top, and to the left side. The first ram 24 also has first side seals 40, one on each side. The second ram 26 similarly has a second seal 39 extending from a right side, over the top, and to the left side. The second ram 26 also has second side seals 41, one on each side. The seals engage with the sides and tops of the guideways 20 and 22 to seal the vertical bore 14 when the rams are fully extended to the closed position by the actuators 28. A ram seal is positioned in a seal channel 42 in the bottom side of the first ram 24 so as to seal between the rams when they are in a closed position. (See FIG. 3B). The first ram 24 has upper guides 44 and lower guides 46 for guiding the first ram 24 in guideway 20 (see FIG. 1A). As shown, one upper guide 44 and one lower guide 46 are on the left side of the ram and another upper guide 44 and another lower guide 46 are on the right side of the first ram 24. The upper and lower guides 44 and 46 define guide channels 48 of the first ram 24 for receiving and guiding the second lower blade 38 and the second side seals 41 of the second ram 26.

Figure 2B:
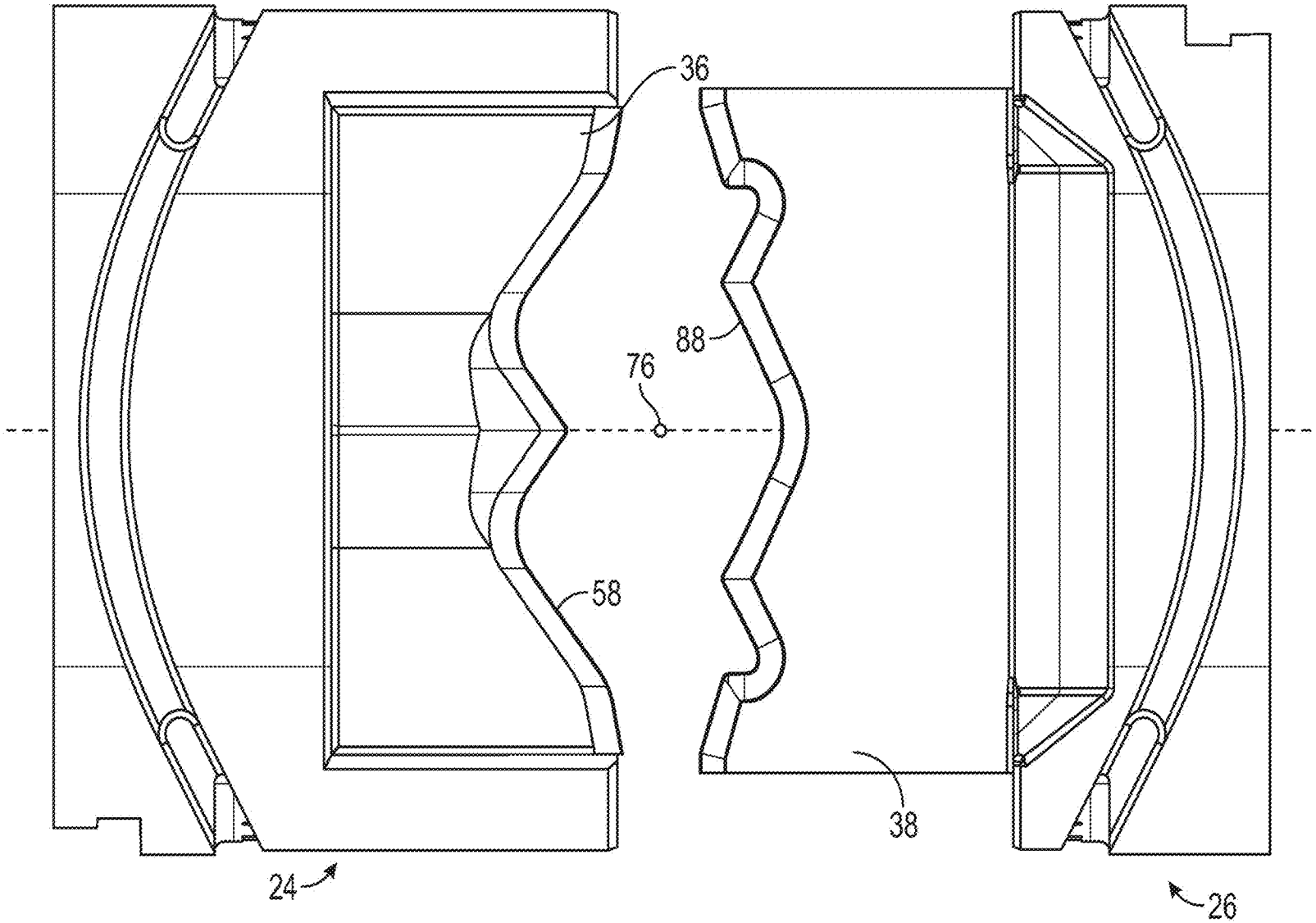
FIG. 2B shows top views of the first and second rams of FIG. 2A.

FIG. 2B is a top view of the embodiment of the first ram 24 and the second ram 26 shown in FIG. 2A, except that the seals are removed from the rams. The first ram 24 has a first upper blade 36, which has a blunt leading contour 58. The second ram 26 has a second lower blade 38, which has a blunt leading contour 88.

Figure 3A:
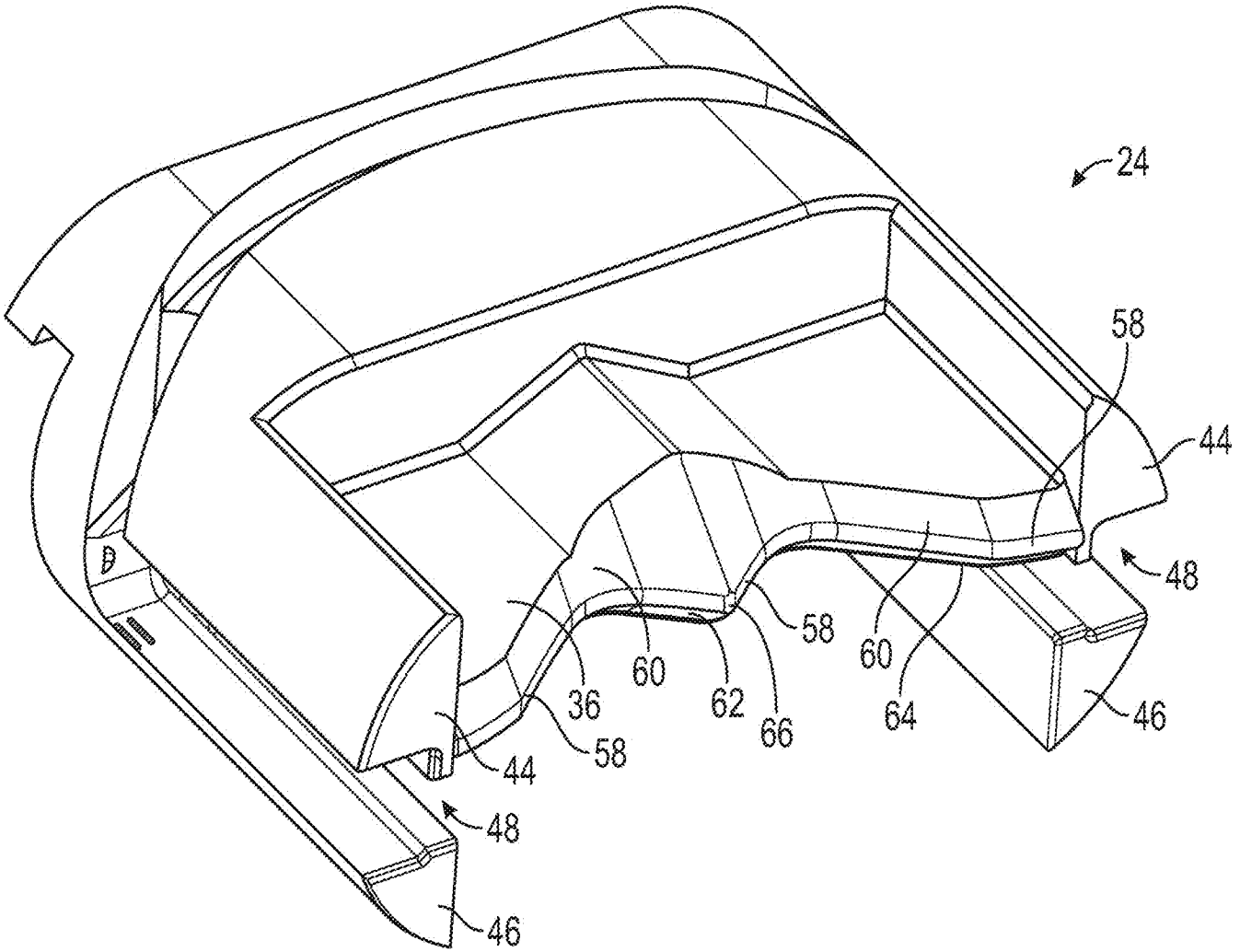
FIG. 3A shows a top perspective view of a first ram.
Figure 3B:
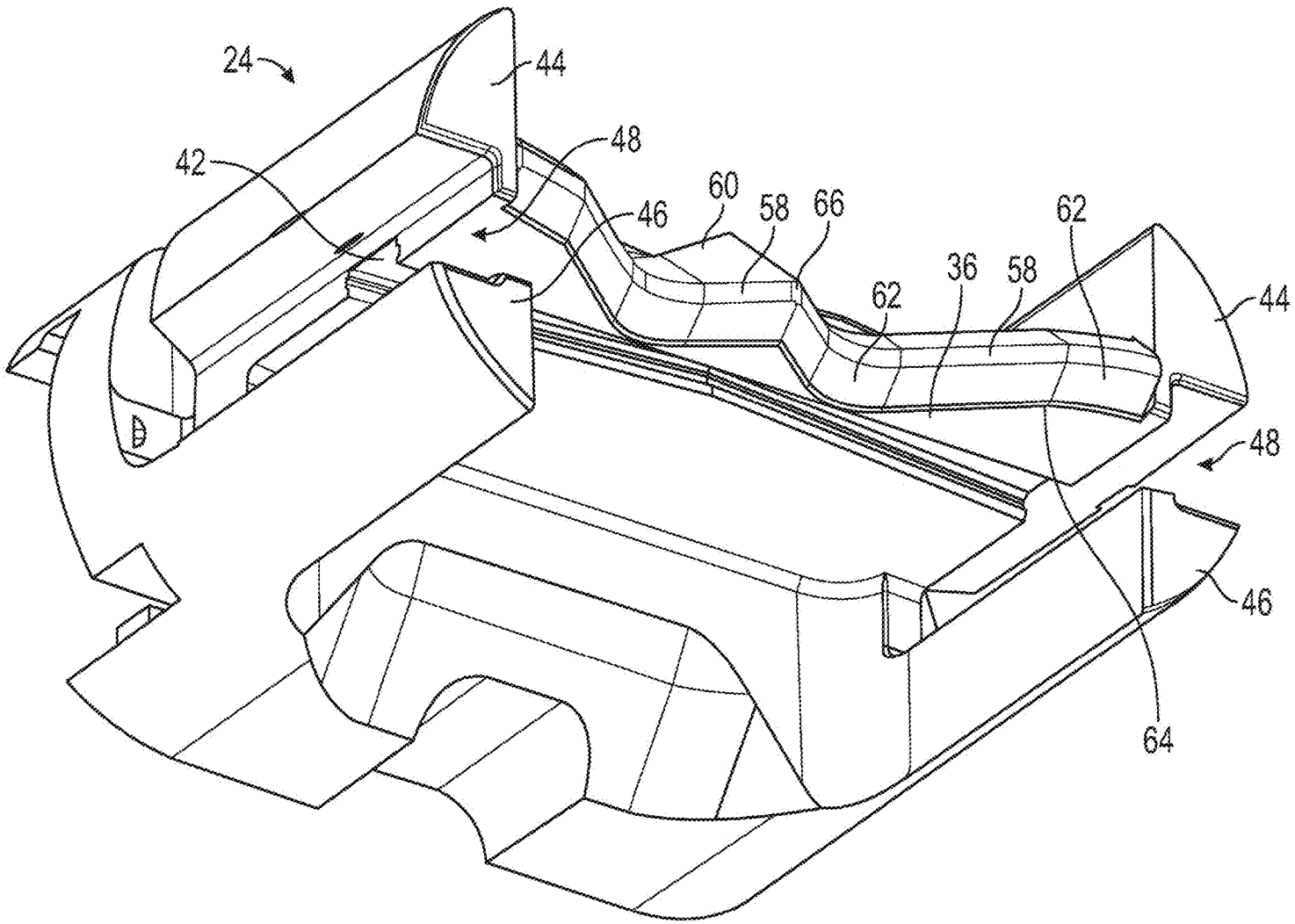
FIG. 3B illustrates a bottom perspective view of the first ram shown in FIG. 3A.

Referring to FIGS. 3A and 3B, top and bottom perspective views of an embodiment of a first ram 24 are shown. The first ram 24 comprises a first upper blade 36 having a blunt leading contour 58 that extends between the upper guides 44 at the front of the blade 36. The first upper blade 36 has upper inclined surfaces 60 extending from the blunt leading contour 58 to the top side 52. At the leading most portions of the bottom side 50, the blade 36 has a cutting edge 64. The first upper blade 36 also has lower inclined surfaces 62 extending from the blunt leading contour 58 to the cutting edge 64. The cutting edge 64 is a very short substantially vertical front side of the blade 36 that meets the bottom side 50. The first upper blade 36 also has lower declined surfaces 62 extending from the blunt leading contour 58 to the cutting edge 64. In the middle of the blunt leading contour 58, the first upper blade 36 has a point 66.

Figure 3C:
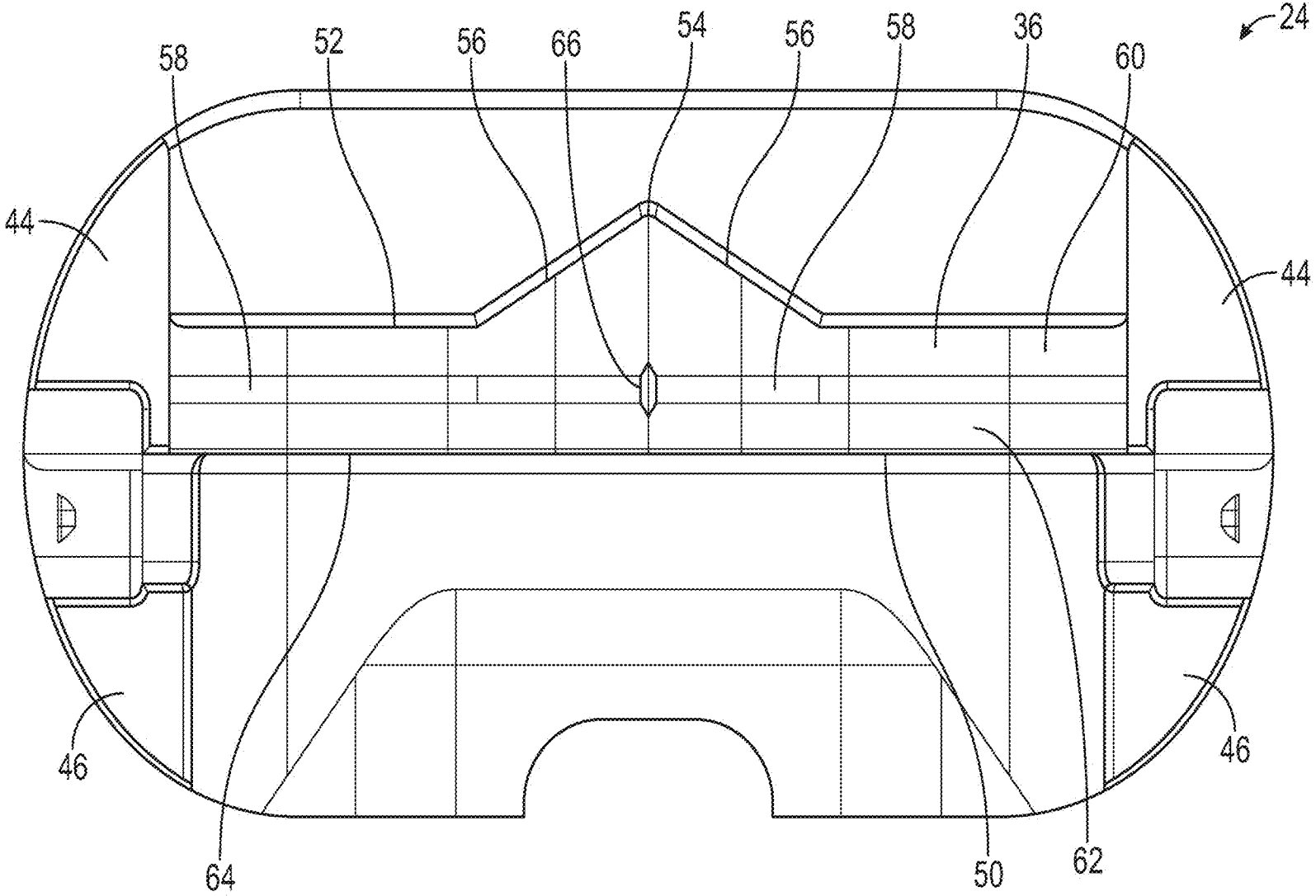
FIG. 3C shows a front view of the first ram shown in FIGS. 3A-3B.

FIG. 3C shows a front view of the first ram 24. As clearly shown in this view, the first upper blade 36 is flat and horizontal on its bottom side 50. The top side 52 of the first upper blade 36 is also flat and horizontal, except that in the mid-section of the blade the top side is pitched to a ridge 54. Ridge planes 56 extend from the flat and horizontal portions of the top side 52 to the ridge 54. The blunt leading contour 58 extends between the upper guides 44 at the front of the blade 36.

Figure 3D:
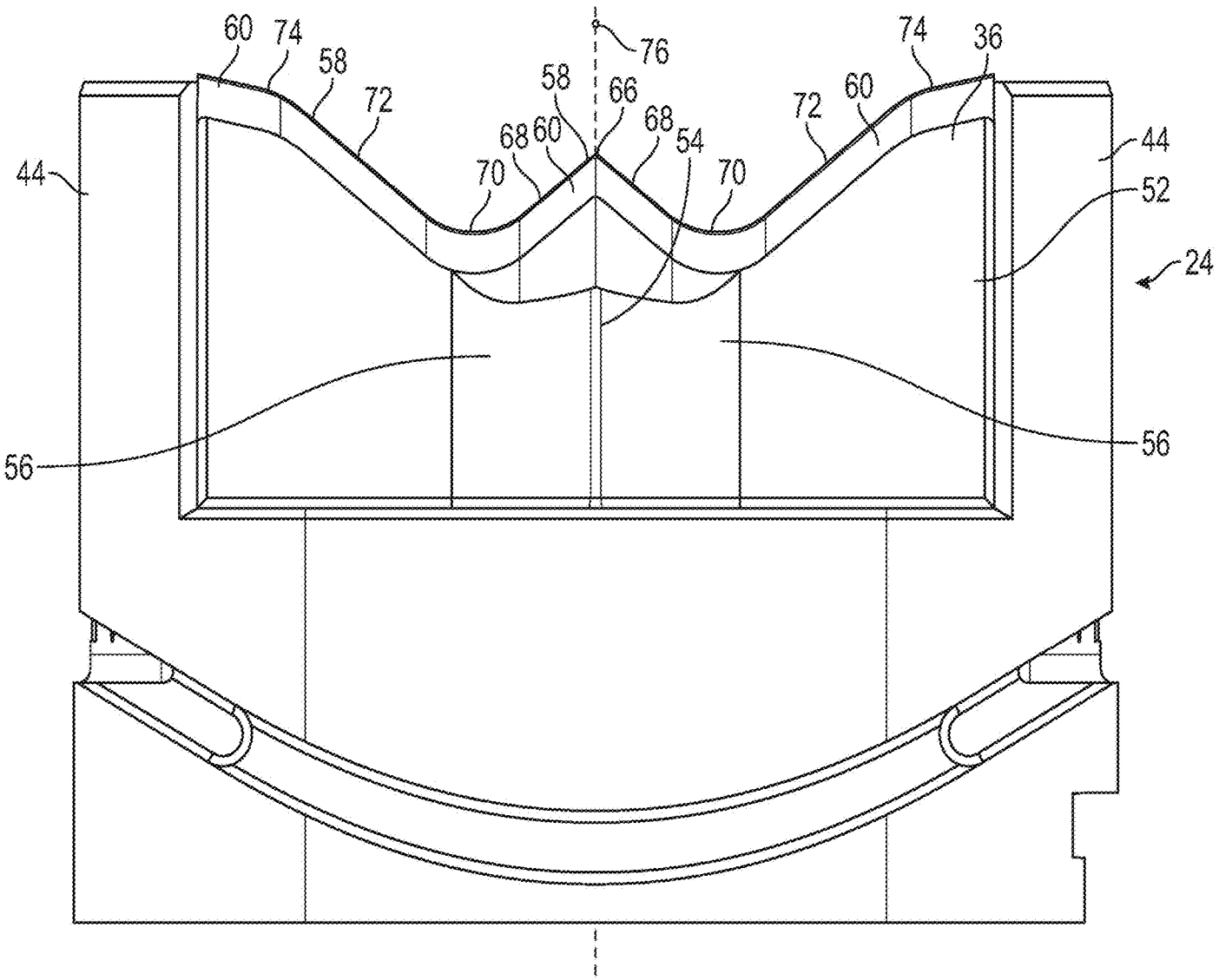
FIG. 3D illustrates a top view of the first ram shown in FIGS. 3A-3C.

FIG. 3D shows a top view of the first ram 24. In this view, the profile of the blunt leading contour 58 is shown extending between the upper guides 44. The point 66 extends from the mid-section of the blunt leading contour 58, with flanks 68 on opposite sides. The flanks 68 merge into concave arcs 70. Each of the concave arcs 70 in the blunt leading contour 58 merge into forward angled sections 72. Each of the forward angled sections 72 merge into convex arcs 74 located adjacent the upper guides 44. Relative to the forward advancing direction of the first ram 24, which is upward in FIG. 3D, the convex arcs 74 are more forward than the point 66. The ridge 54 is on the centerline 76 of the first ram 24. The flanks 68 sweep backwardly from the point 66 at an angle of about 65 degrees from the centerline 76. Said another way, the flanks 68 form an angle of about 130 degrees at the point 66. In some embodiments, the flanks 68 form an angle between about 110 to 150 degrees at the point 66. The forward angled sections 72 sweep forwardly at an angle of about 52 degrees from the centerline 76. The concave arcs 70 have radii about 8% the width of the first upper blade 36 between the upper guides 44.

Figure 3E:
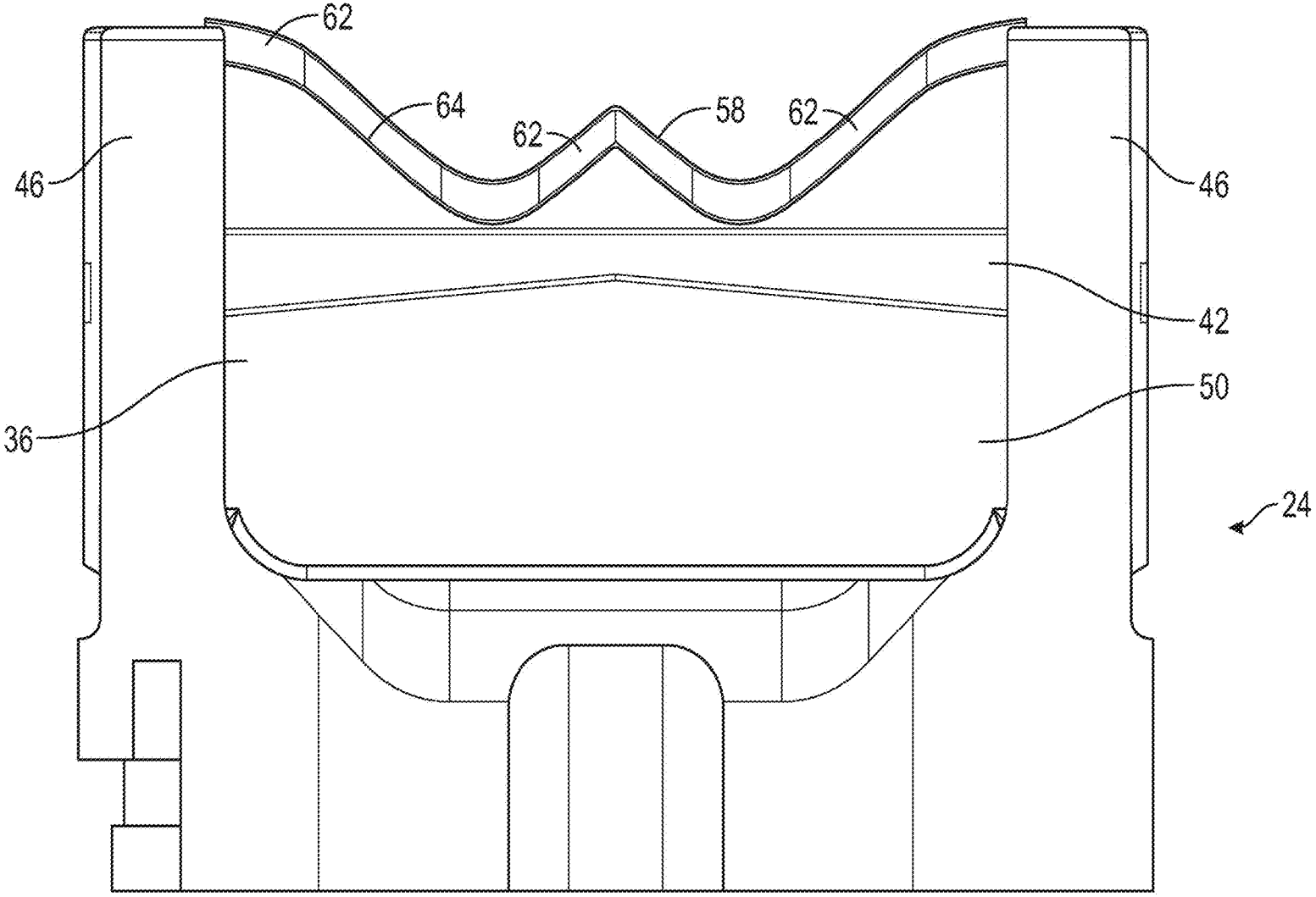
FIG. 3E shows a bottom view of the first ram shown in FIGS. 3A-3D.

Referring to FIG. 3E, a bottom view is shown of the embodiment of the first ram 24 of FIGS. 3A-3D. In this view, the bottom side of the first upper blade 36 is visible between the lower guides 46. A seal channel 42 is located in the bottom side 50. A seal may be positioned in the seal channel 42 for sealing engagement between the first upper blade 36 and the second lower blade 38 (see FIG. 2) when the rams are closed. The profile of the blunt leading contour 58 is also visible in FIG. 3E. Further, from this perspective, the cutting edge 64 is also visible. The cutting edge 64 has a profile similar to the blunt leading contour 58. Lower decline surfaces 62 extend between the blunt leading contour 58 and the cutting edge 64.

Figure 3F:
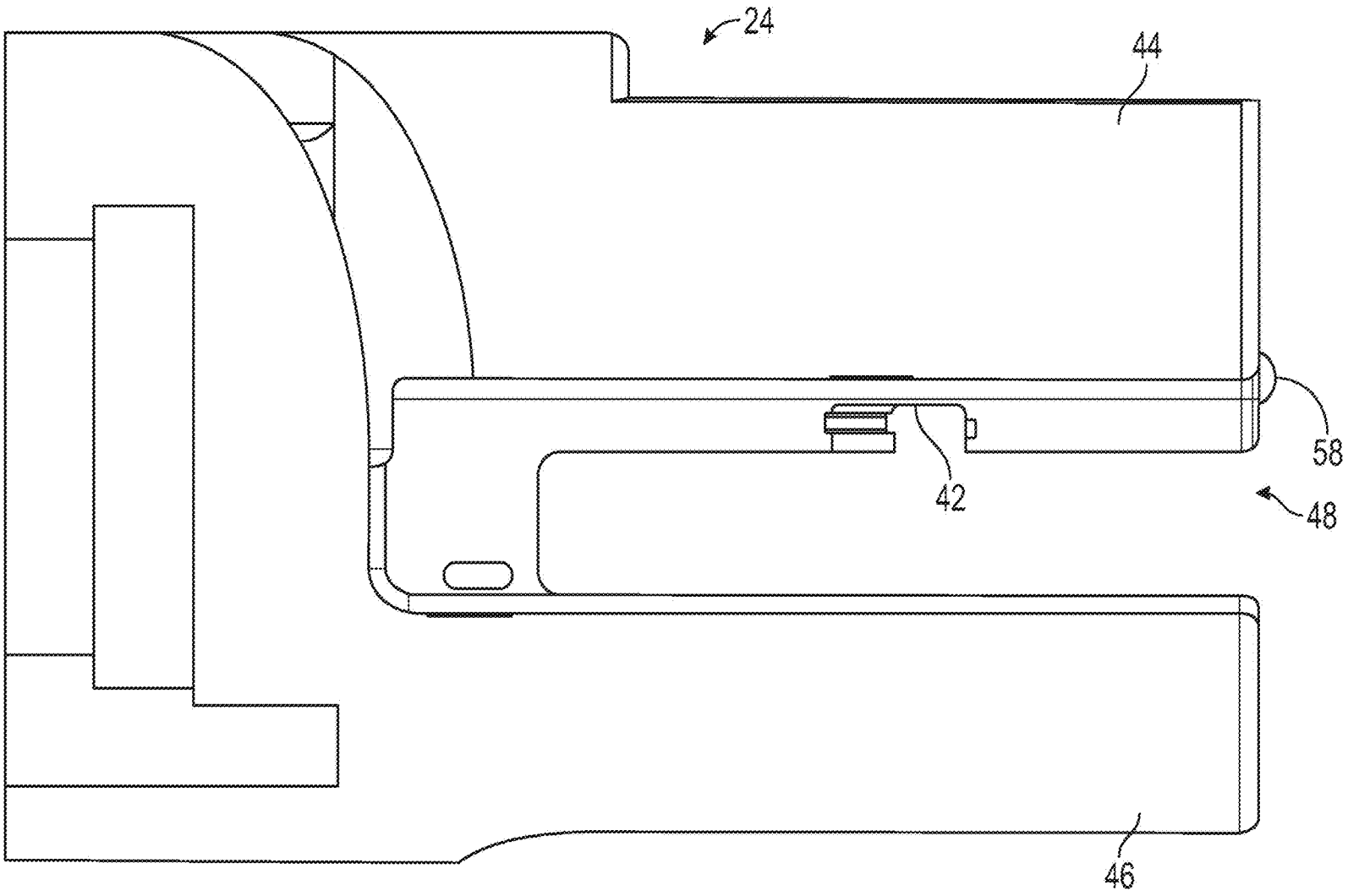
FIG. 3F shows a side view of the first ram shown in FIGS. 3A-3E.

FIG. 3F shows a right side view of the first ram 24. An upper guide 44 is at the top of the first ram 24 and a lower guide 46 is at the bottom of the first ram 24. A guide channel 48 is bounded between the upper and lower guides 44 and 46. The blunt leading contour 58 extends slightly beyond the distal end of the upper guide 44. In this view, the depth and width of the seal channel 42 are clearly visible. In one embodiment, the inclination angle of the upper inclined surfaces 60 and the declination angle of the lower declined surfaces 62 of the first upper blade 36 may be about 40 degrees from horizontal. (See FIG. 3C).

Figure 4A:
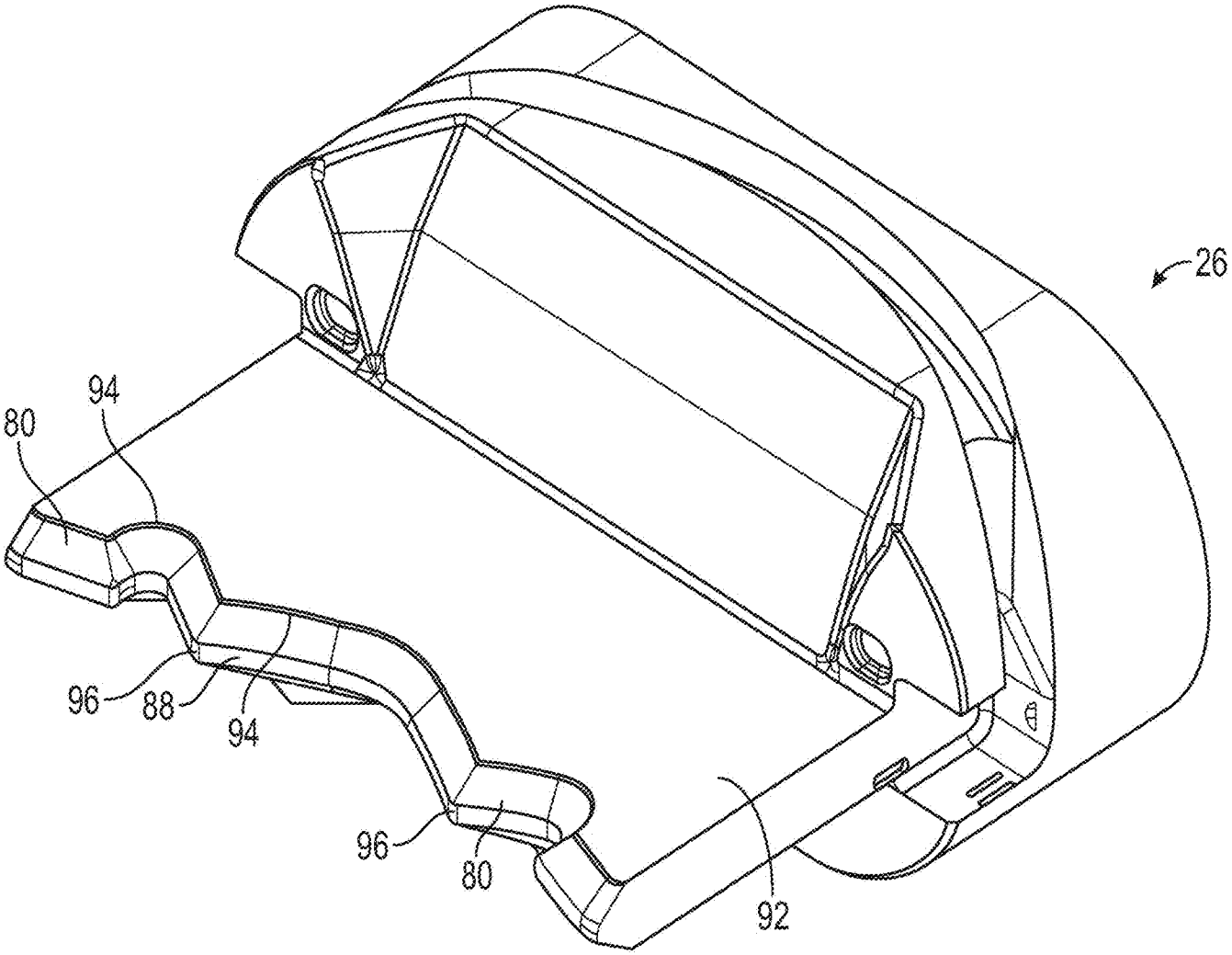
FIG. 4A shows a top perspective view of a second ram.
Figure 4B:
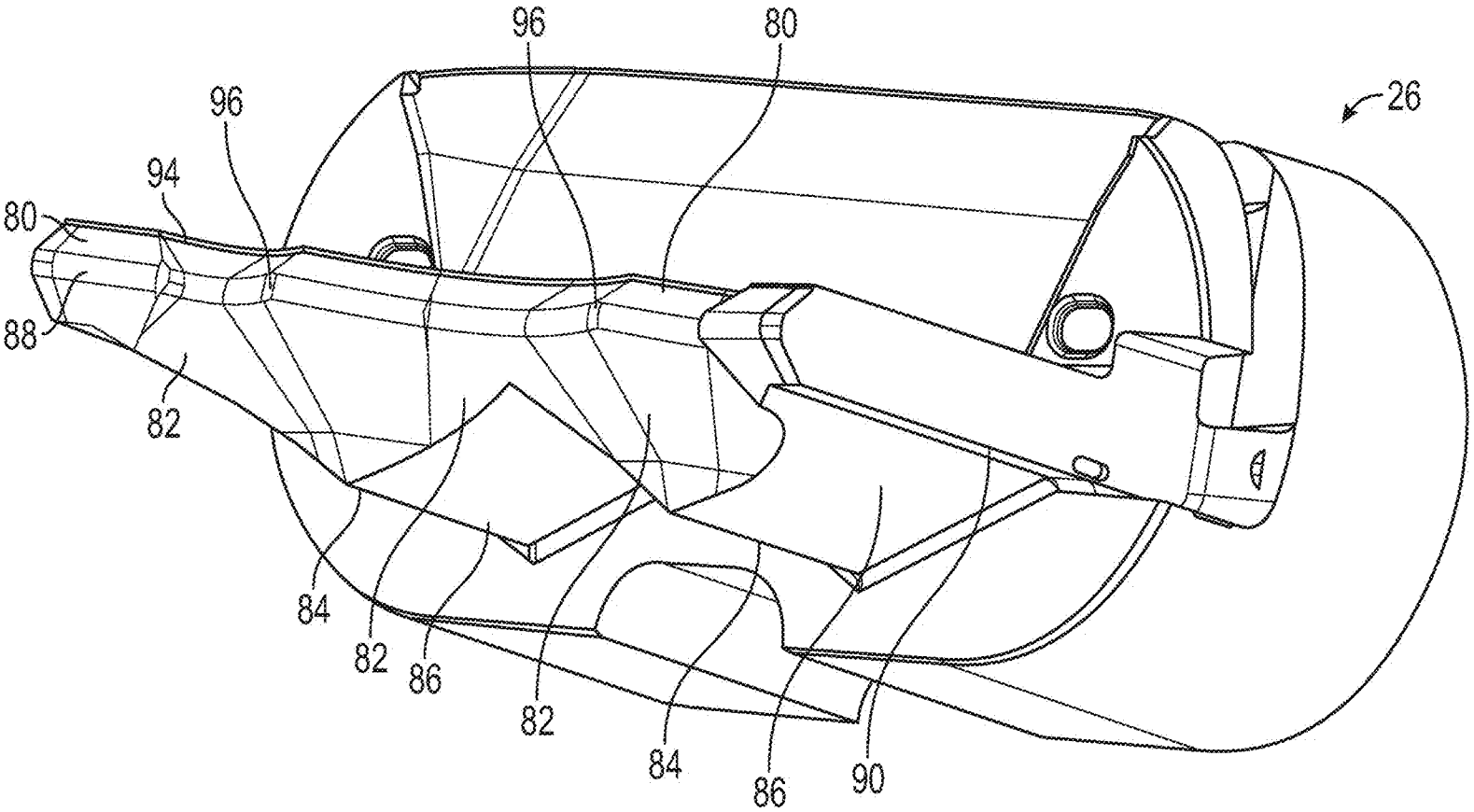
FIG. 4B illustrates a bottom perspective view of the second ram shown in FIG. 4A.

Referring to FIGS. 4A and 4B, top and bottom perspective views of an embodiment of a second ram 26 are shown. The second ram 26 comprises a second lower blade 38 having a top side 92, a bottom side 90, and a blunt leading contour 88 at the front of the blade 38. At the leading most portions of the top side 92, the blade 38 has a cutting edge 94. The cutting edge 94 is a very short substantially vertical front side of the blade 38 that meets the top side 92 at a substantially 90 degree corner. The second lower blade 38 has upper inclined surfaces 80 extending from the blunt leading contour 88 to the cutting edge 94 at the leading boundary of the top side 92. The second lower blade 38 also has lower declined surfaces 82 extending from the blunt leading contour 88 to the bottom side 90. The blunt leading contour 88 of the second lower blade 38 has two points 96.

Figure 4C:
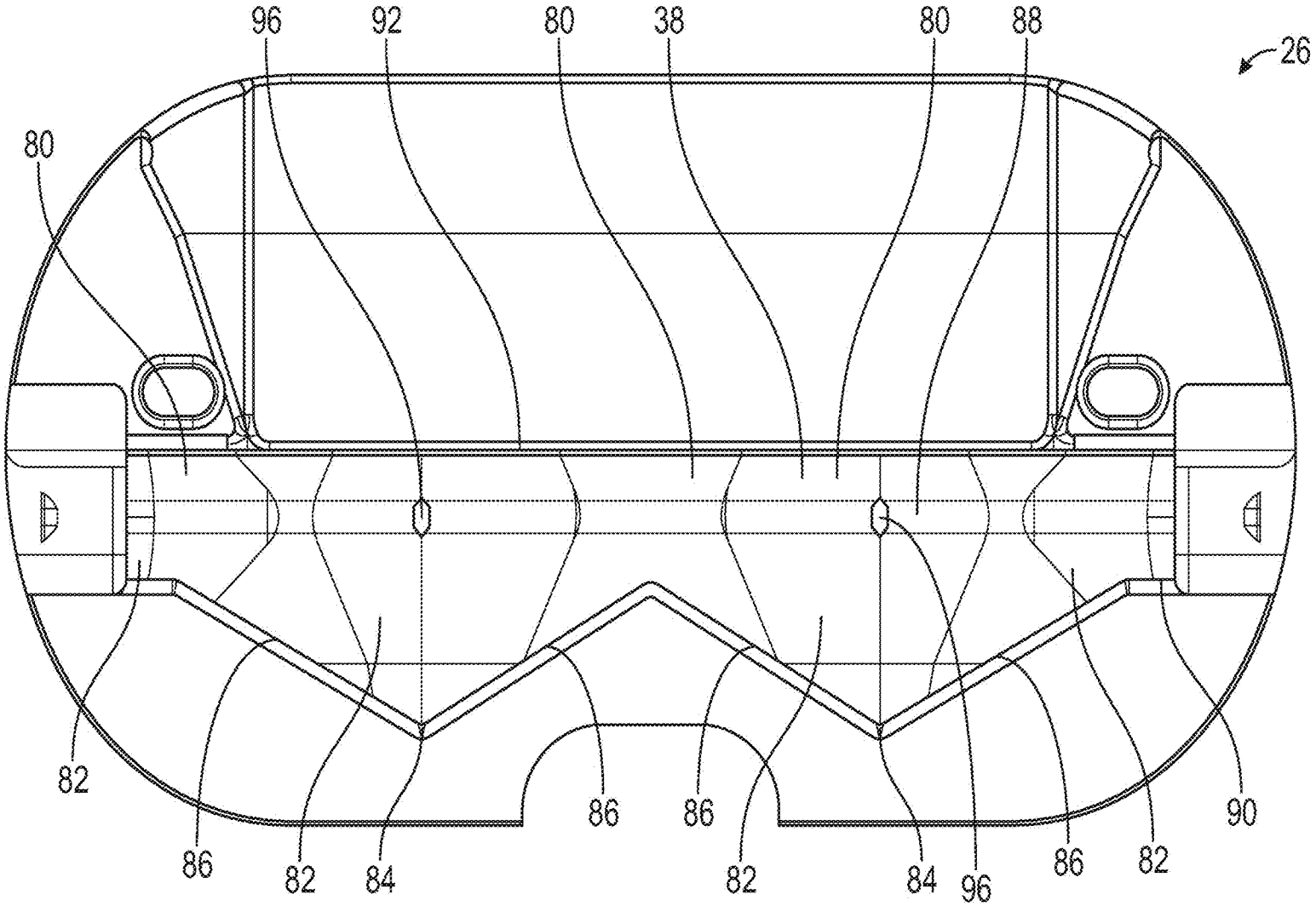
FIG. 4C shows a front view of the second ram shown in FIGS. 4A-4B.

FIG. 4C shows a front view of the second ram 26. As clearly shown in this view, the second lower blade 38 is flat and horizontal on its top side 92. The bottom side 90 of the second lower blade 38 is also flat and horizontal, except that first and second thirds of the width of the blade 38 the bottom side 90 is pitched to two ridges 84. Ridge planes 86 extend from the flat and horizontal portions of the bottom side 90 to the ridges 84. The blunt leading contour 88 extends across front of the blade 39 between the upper inclined surfaces 80 and the lower declined surfaces 82. Two pointes 96 are at about the first and second thirds of the width of the blade 38.

Figure 4D:
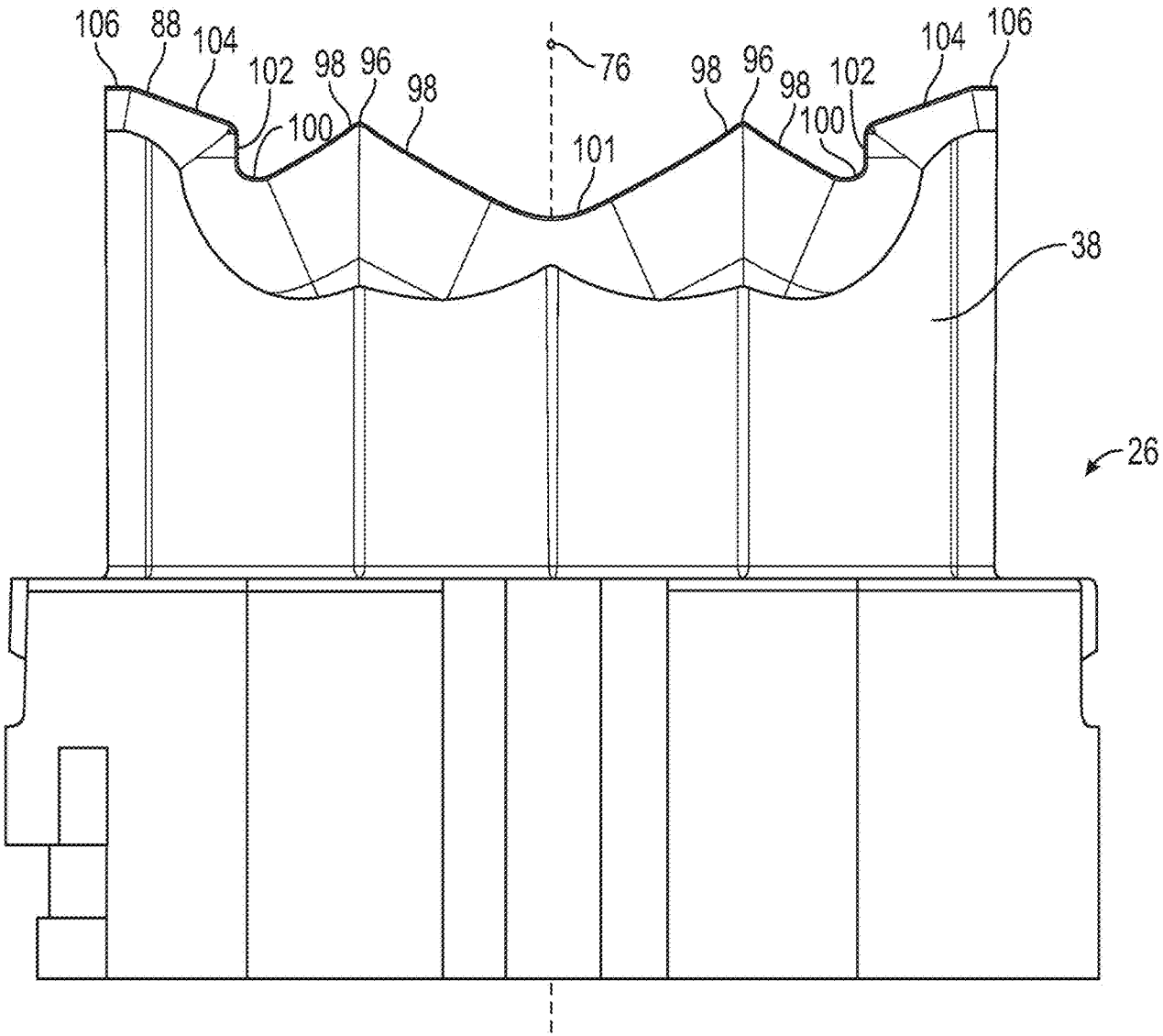
FIG. 4D illustrates a bottom view of the second ram shown in FIGS. 4A-4C.

FIG. 4D shows a bottom view of the second ram 26. In this view, the profile of the blunt leading contour 88 is shown at the leading portion of the second lower blade 38. The blunt leading contour 88 is symmetrical about the centerline 76. Two points 96 extend from the first and second thirds of the width of the blunt leading contour 88, with flanks 98 on opposite sides of each point 96. The flanks 98 merge into concave arcs 100 toward the ends of the blade 38 and merge into a common concave arc 101 at the mid-section. Each of the concave arcs 100 in the blunt leading contour 88 merge into forward sections 102, which are substantially parallel to the centerline 76. Each of the forward sections 102 merge into forward angled sections 104. The forward angled sections 104 finally merge into transverse sections 106, which are substantially transverse to the centerline 76. Relative to the forward advancing direction of the first ram 24, which is upward in FIG. 4D, the transverse sections 106 are more forward than the points 96. The ridges 84 are colinear with the points 96. The flanks 98 sweep backwardly from the points 96 at angle of about 60 degrees from the centerline 76. The forward angled sections 104 sweep forwardly at an angle of about 75 degrees from the centerline 76. The concave arcs 100 have radii about 3% the width of the second lower blade 38. The common concave arc 101 has a radius about 10% the width of the second lower blade 38.

Figure 4E:
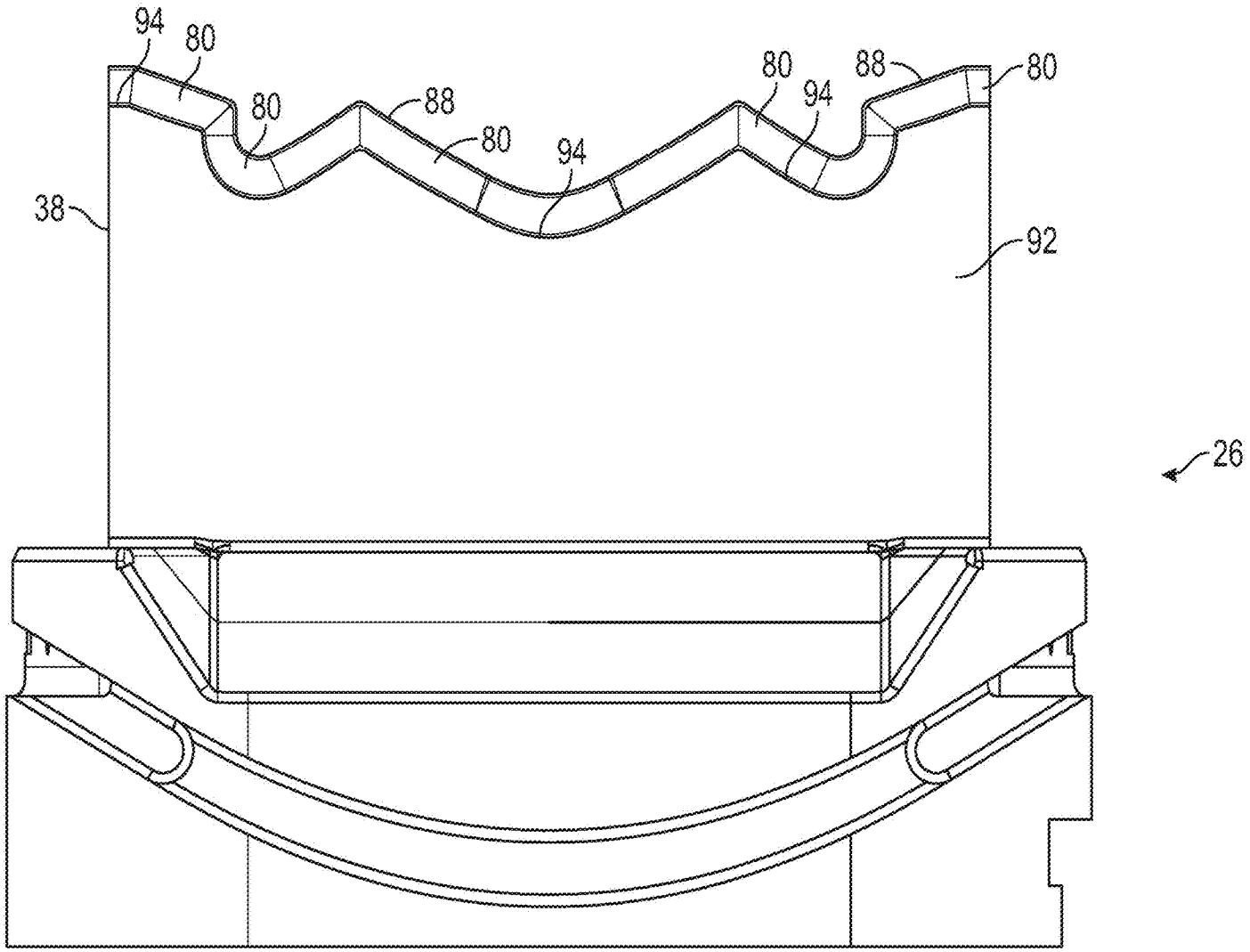
FIG. 4E shows a top view of the second ram shown in FIGS. 4A-4D.

Referring to FIG. 4E, a top view is shown of the embodiment of the second ram 26 of FIGS. 4A-4D. In this view, the top side 92 of the second lower blade 38 is visible. The profile of the blunt leading contour 88 is also visible in FIG. 4E. Further, from this perspective, the cutting edge 94 is also visible. The cutting edge 94 has a profile similar to the blunt leading contour 88. Upper incline surfaces 80 extend between the blunt leading contour 88 and the cutting edge 94.

Figure 4F:
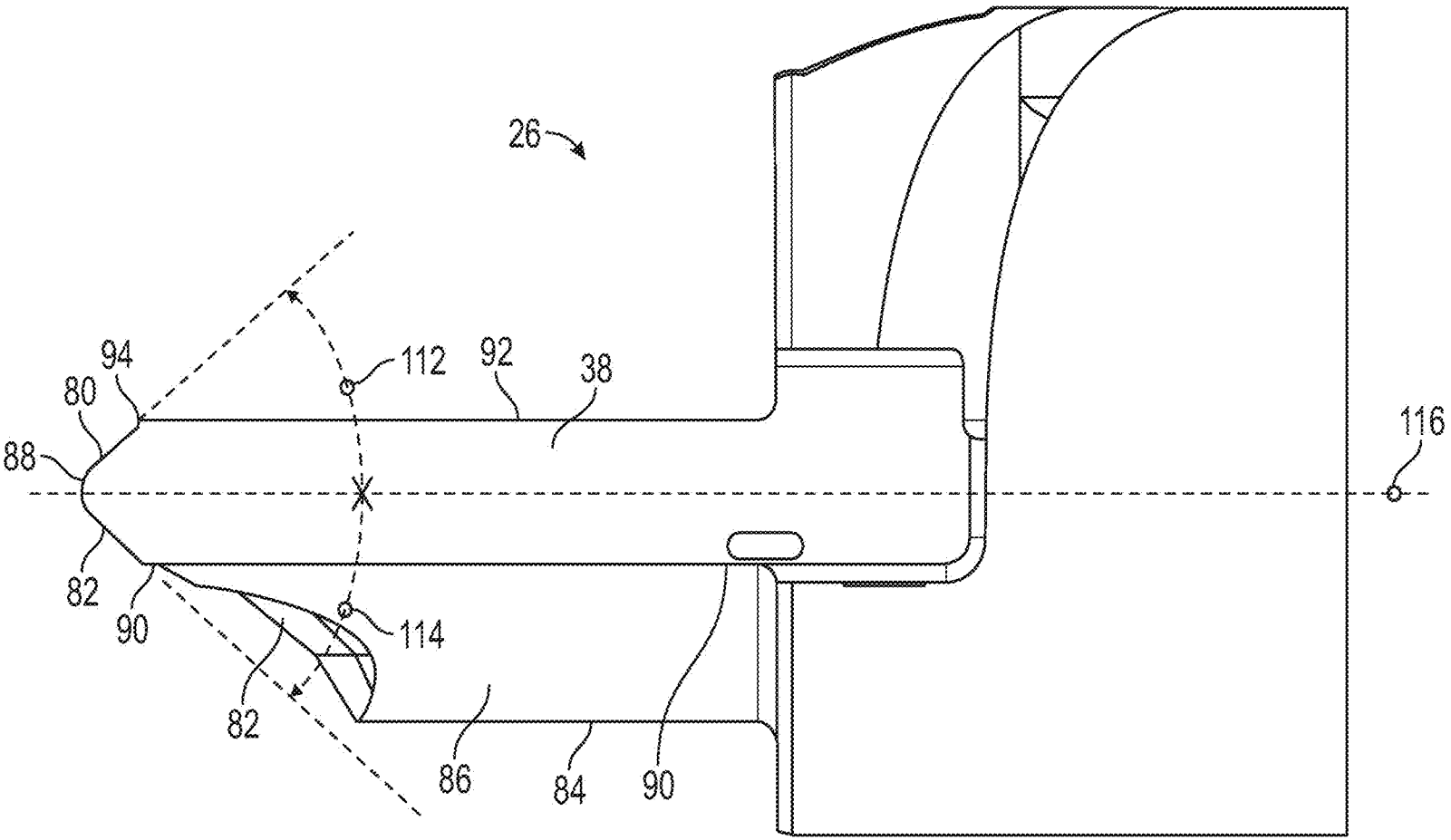
FIG. 4F shows a side view of the second ram shown in FIGS. 4A-4E.

FIG. 4F shows a left side view of the second ram 26. The blunt leading contour 88 is located at the distal end of the second lower blade 38. The top side 92 is opposite the bottom side 90. A ridge 84 is at the bottom most portion of the blade 38. A ridge plane 86 extends between the ridge 84 and the bottom side 90 of the blade 38. An upper inclined surface 80 extends between the blunt leading contour 88 and the cutting edge 94. In this embodiment, the top side 92 is flat. A reference horizontal plane 116 cuts through the middle of the blunt leading contour 88 and is parallel to the top side 92. The upper inclined surface 80 has an inclination angle 112 of about 40 degrees relative to the reference horizontal plane 11. Said another way, the upper inclined surface forms an angle of about 140 degrees with the top side 92. In some embodiments, the upper inclined surface forms an angle between about 120 and 160 degrees with the top side 92. A lower decline surface 82 extends between the blunt leading contour 88 and the bottom side 90 of the blade 38. In this embodiment, the lower decline surface 82 has a declination angle 114 of about 40 degrees from reference horizontal plane 116. Said another way, the lower declined surface 82 forms an angle of about 80 degrees with the upper inclined surface 80. In some embodiments, the lower declined surface 82 forms an angle between about 60 and 100 degrees with the upper inclined surface 80. Further, lower decline surfaces 82 extend from various portions of the blunt leading contour 88 to the ridge plane 86.

A further aspect of the invention is that the first upper blade 36 functions to rip tubular, tools, or whatever else is located in the vertical bore of the blowout preventer body 12. The first and second blades 36 and 38 may be formed and positioned such that the second blade 38 passes below the first blade 36 in shearing of a section of a tubular D. (See FIG. 1C). The shearing action of first and second blades 36 and 38 may shear whatever structures are located in the vertical bore 14 of the blowout preventer 10. The blades may shear; (1) tubulars D of any diameter that may be inserted into the vertical bore 14; (2) tool joint; (3) drill collar; (4) production tubular; (5) hard banded tubular; (6) casing tubular; (7) tubular pin/box connections of any diameter; (8) coil tubing of any diameter; (9) tools, such as wireline tools, perforating guns, drill bits, fishing tools, etc.; (10) wireline; and (11) any other objects that may find their way into the vertical bore 14 of the blowout preventer 10. Referring again to FIG. 2B, relatively larger diameter tubular may become positioned at the centerline 76 where it may be initially engaged by the point 66 of the first upper blade 36 and the common concave are 101 of the second lower blade 38. Relatively smaller diameter tubular may similarly become positioned at the centerline 76, or it may become position away from the centerline 76 wherein it may be initially engaged by one of the points 96 of the second lower blade 38 and a concave arc 70 of the first upper blade 36. Still smaller diameter tubulars may be positioned in either of these locations, or may be positioned still further away from the centerline 76 and be initially engaged by a forward angled section 72 of the first upper blade 36 and an outside flank 98 of the second lower blade 38.

The rams 24 and 26 may consists of blunt leading contours 58 and 88 running horizontally across the blades 36 and 38. The rounded blunt leading contours 58 and 88 may terminate in two symmetric angled surfaces (upper inclined surface 60 and 80 and lower declined surface 62 and 82), where the angle between the surfaces is less than 90 degrees (inclination angle 112+declination angle 114 shown in FIG. 4F). Once contact is initiated with the pipe tubular D, the rounded blunt leading contour 58 will indent the pipe tubular D at which time the upper inclined surface 60 and 80 and lower declined surface 62 and 82 will begin to force the contact region open as the ram 24 and 26 continues its forward motion, thereby imparting a tensile load at the point of contact. The blade 36 and 38 may cause the pipe tubular D to fail in a ripping manner, rather than a traditional shear manner.

Figure 4G:
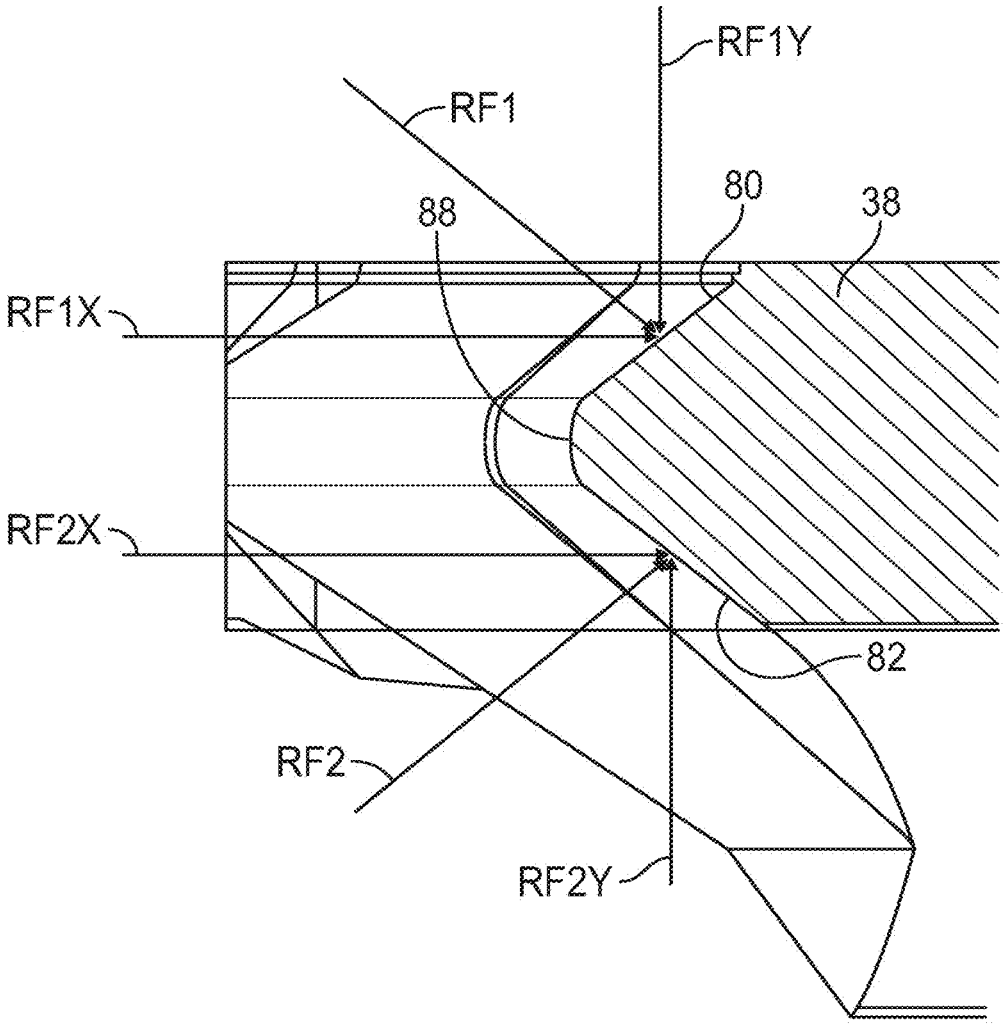
FIG. 4G shows a side view of a portion of a blade of the second ram shown in FIGS. 4A-4F.

For example, FIG. 4G shows a cross-sectional side view of a second lower blade 38, the upper inclined surface 80 and lower declined surface 82 surrounding the bull nose or rounded blunt leading contour 88 reduce the propensity of the blade 38 to bend during emergency disconnect operations. The rounded blunt leading contour 88 is substantially symmetric causing reaction forces in the vertical direction RF1Y and RF2Y to be balanced during closing operations. Thus, the "bull nose design" enhances the structural integrity of the blade during well control operations.

Figure 5A:
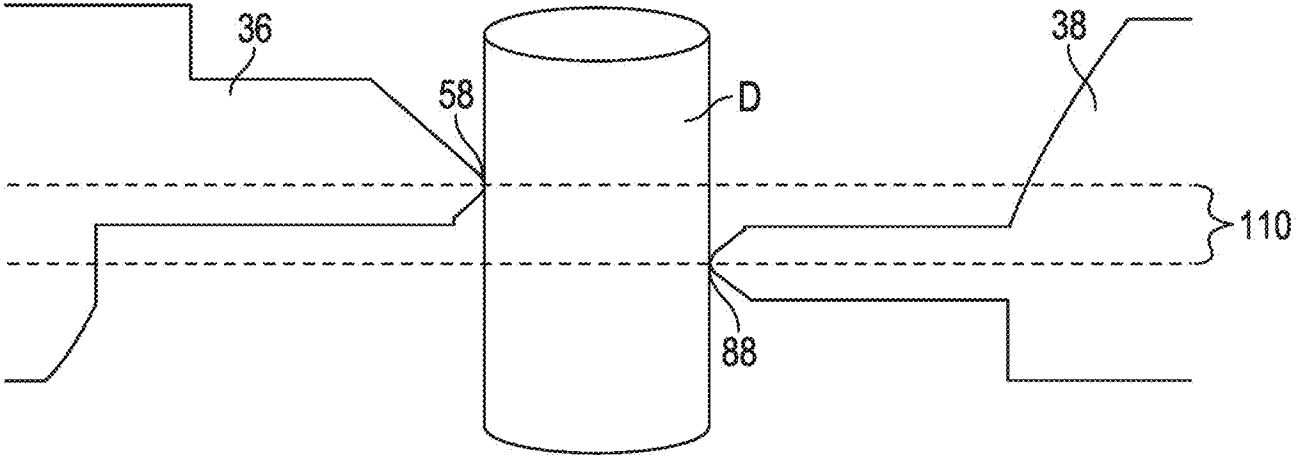
FIG. 5A illustrates a side view of first and second blades initially engaging a tubular in a blowout preventer.

FIG. 5A shows cross-sectional side views of the first upper blade 36 and the second lower blade 38 at positions of initial engagement with a tubular D. Because the blades have inclined and declined surfaces, the blunt leading contour 58 of the first upper blade 36 and the blunt leading contour 88 of the second lower blade 38 are vertically offset from each other by an offset distance 110. Rather than a sharp leading edge, the blades 36 and 38 present blunt leading contours 58 and 88.

Figure 5B:
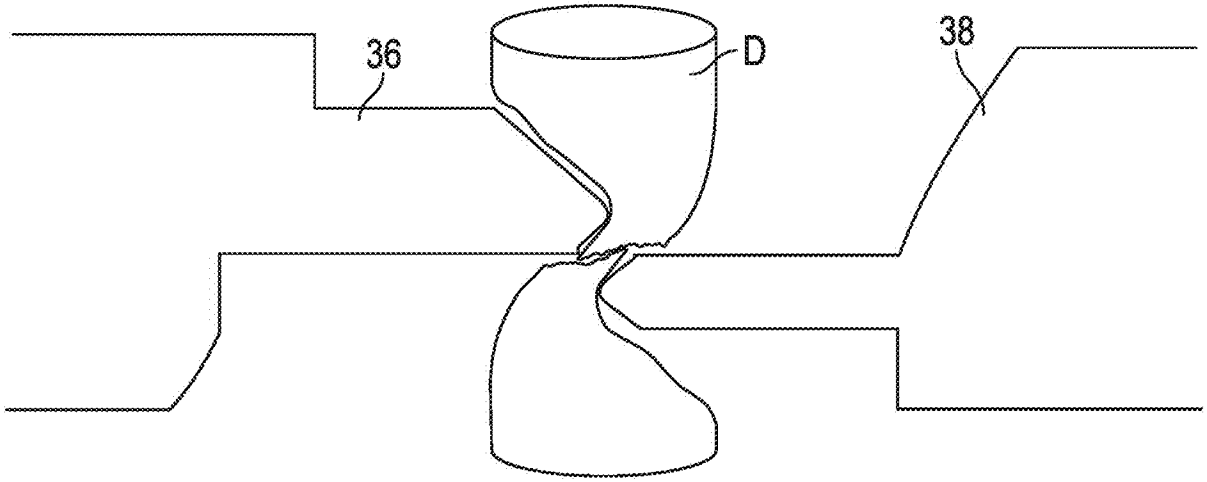
FIG. 5B shows a side view of the first and second blades of FIG. 5A fully engaging to shear or rip the tubular.

FIG. 5B shows cross-sectional side views of the first upper blade 36 and the second lower blade 38 of FIG. 5A at positions of full engagement with the tubular D. The blades engage the tubular D in opposite horizontal inward directions to induce horizontal shear forces in the tubular D. Further, the offset distance 110 between the leading contours enables the blades to induce vertical tensile and shear forces in the tubular D. These forces combine to rip and tear the tubular D, rather than slice or cut.

Figure 6A:
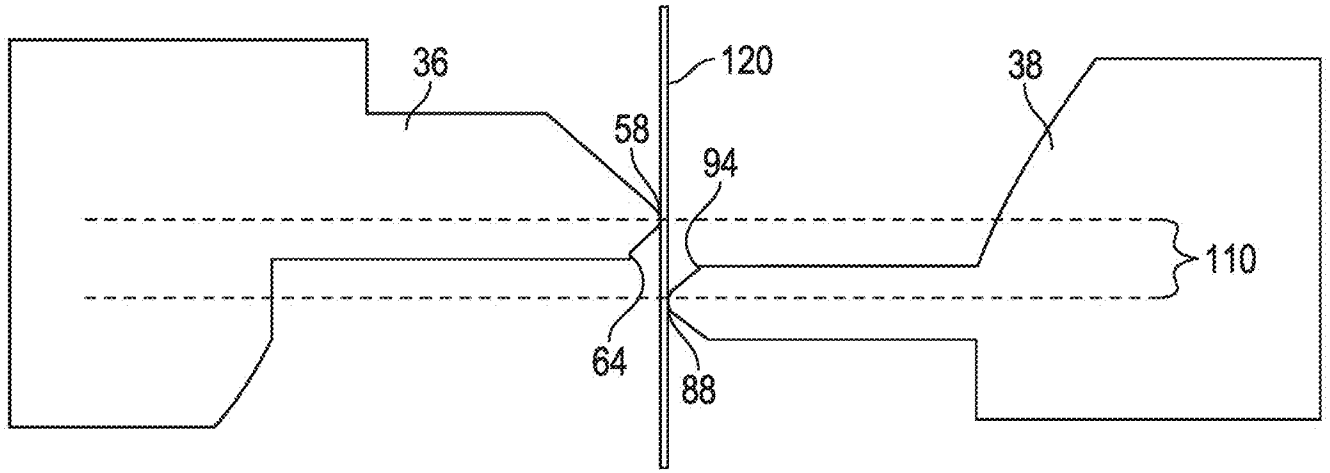
FIG. 6A illustrates a side view of first and second blades initially engaging a wire in a blowout preventer.

FIG. 6A shows cross-sectional side views of the first upper blade 36 and the second lower blade 38 at positions of initial engagement with a wireline 120. Because the blades have inclined and declined surfaces, the blunt leading contour 58 of the first upper blade 36 and the blunt leading contour 88 of the second lower blade 38 are vertically offset from each other by an offset distance 110. Rather than a sharp leading edge, the blades 36 and 38 present blunt leading contours 58 and 88. Cutting edge 64 and cutting edge 94 present sharper edges capable of cutting wireline 120.

Figure 6B:
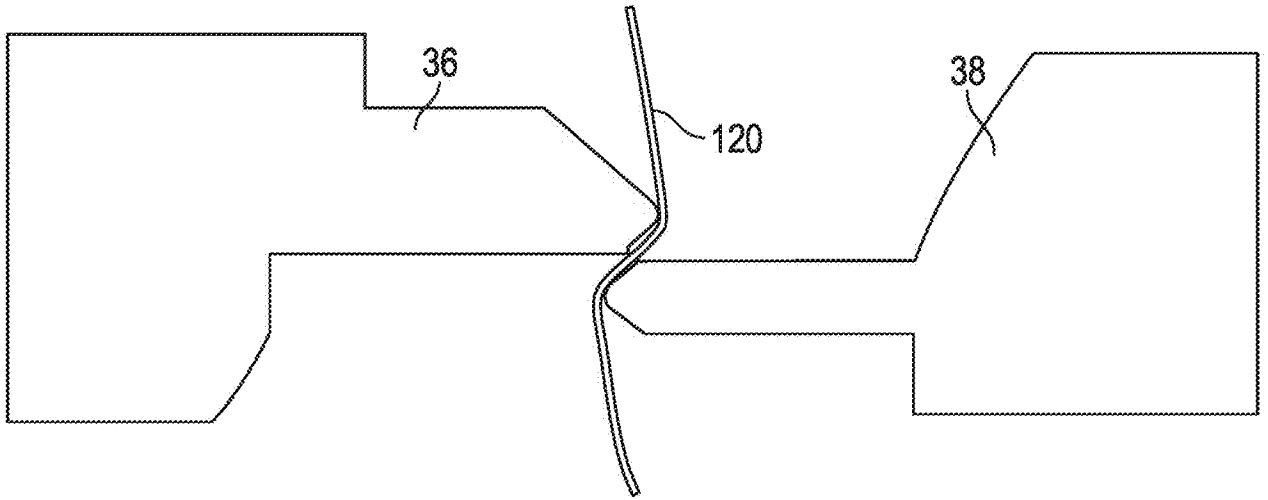
FIG. 6B shows a side view of the first and second blades of FIG. 5A fully engaging to cut the wireline.

FIG. 6B shows cross-sectional side views of the first upper blade 36 and the second lower blade 38 of FIG. 6A at positions of full engagement with the wireline 120. The blades engage the tubular D in opposite horizontal inward directions so that the wireline 120 simply deforms around the blunt leading contours 58 and 88 in an S-shape. Further inward movement of the blades 36 and 38 causes the cutting edges 64 and 94 to engage and cut the wireline 120.

Figure 7A:
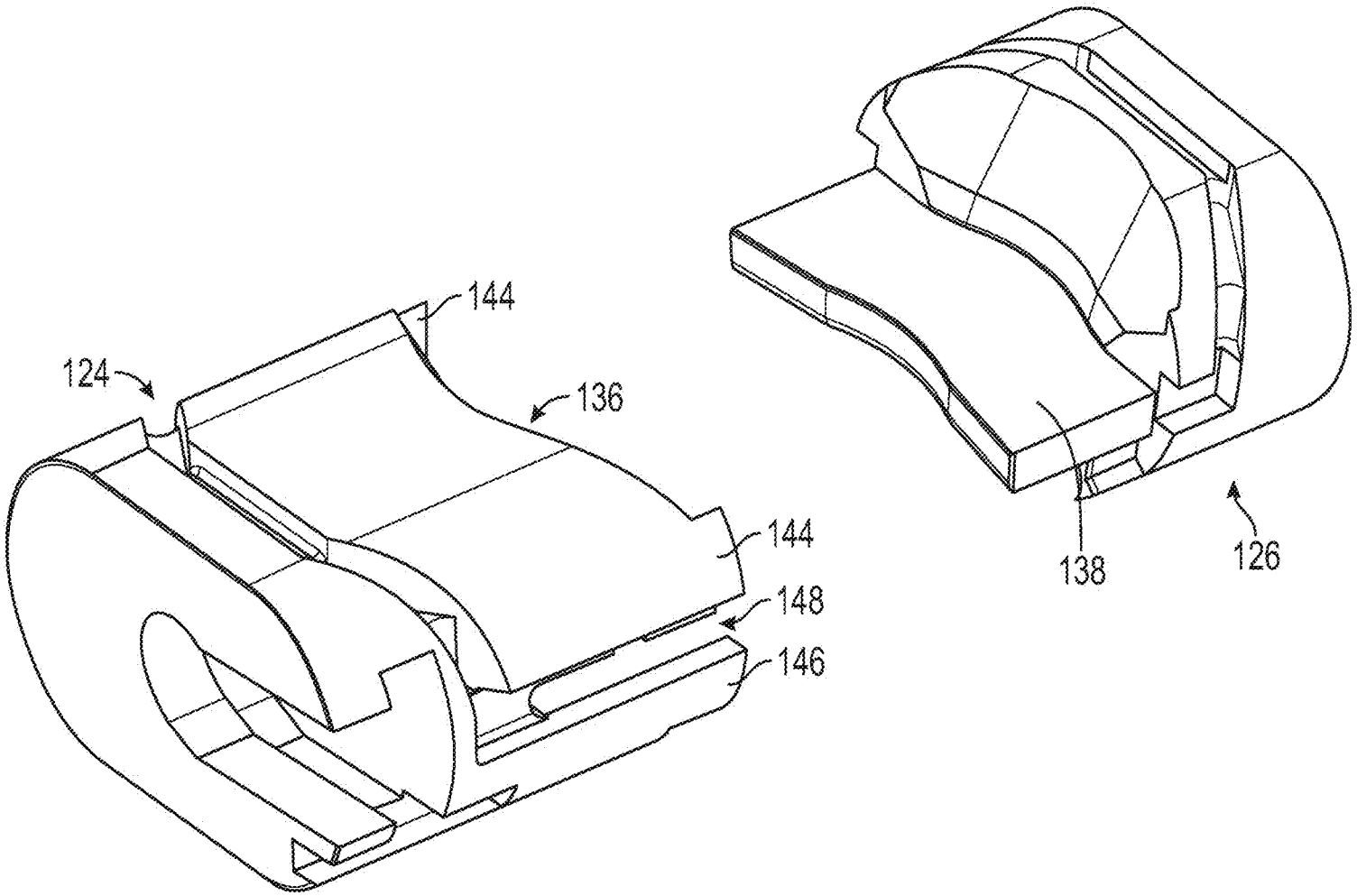
FIG. 7A illustrates perspective views of first and second rams.

Referring to FIG. 7A, a perspective view of an embodiment of a first ram 124 and a second ram 126 are shown. The rams are positioned opposite each other as they would be if positioned within the guideways 20 and 22 of the body 12 of the blowout preventer 10 (see FIGS. 1A-1D). The rams also have seals similar to the embodiment shown in FIGS. 2A-2B. The first ram 124 has upper guides 144 and lower guides 146 for guiding the first ram 124 in guideway 20 (see FIG. 1A). As shown, one upper guide 144 and one lower guide 146 are on the left side of the ram and another upper guide 144 and another lower guide 146 are on the right side of the first ram 124. The upper and lower guides 144 and 146 define guide channels 148 of the first ram 124 for receiving and guiding the second lower blade 138 of the second ram 26.

Figure 7B:
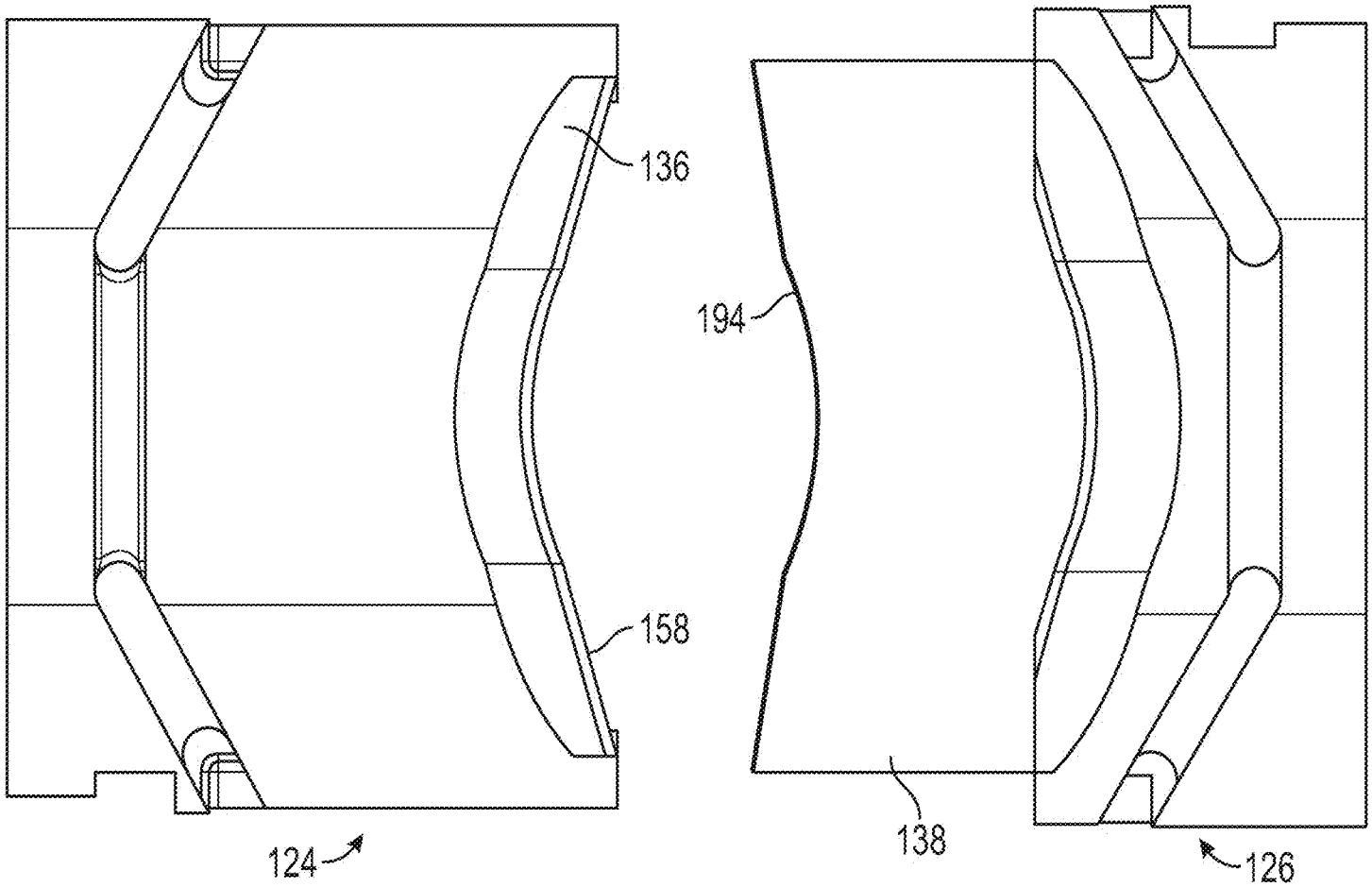
FIG. 7B shows top views of the first and second rams of FIG. 7A.

FIG. 7B is a top view of the embodiment of the first ram 124 and the second ram 126 shown in FIG. 7A. The first ram 124 has a first upper blade 136, which has a blunt leading contour 158. The second ram 126 has a second lower blade 138, which has a cutting edge 194.

Figure 8A:
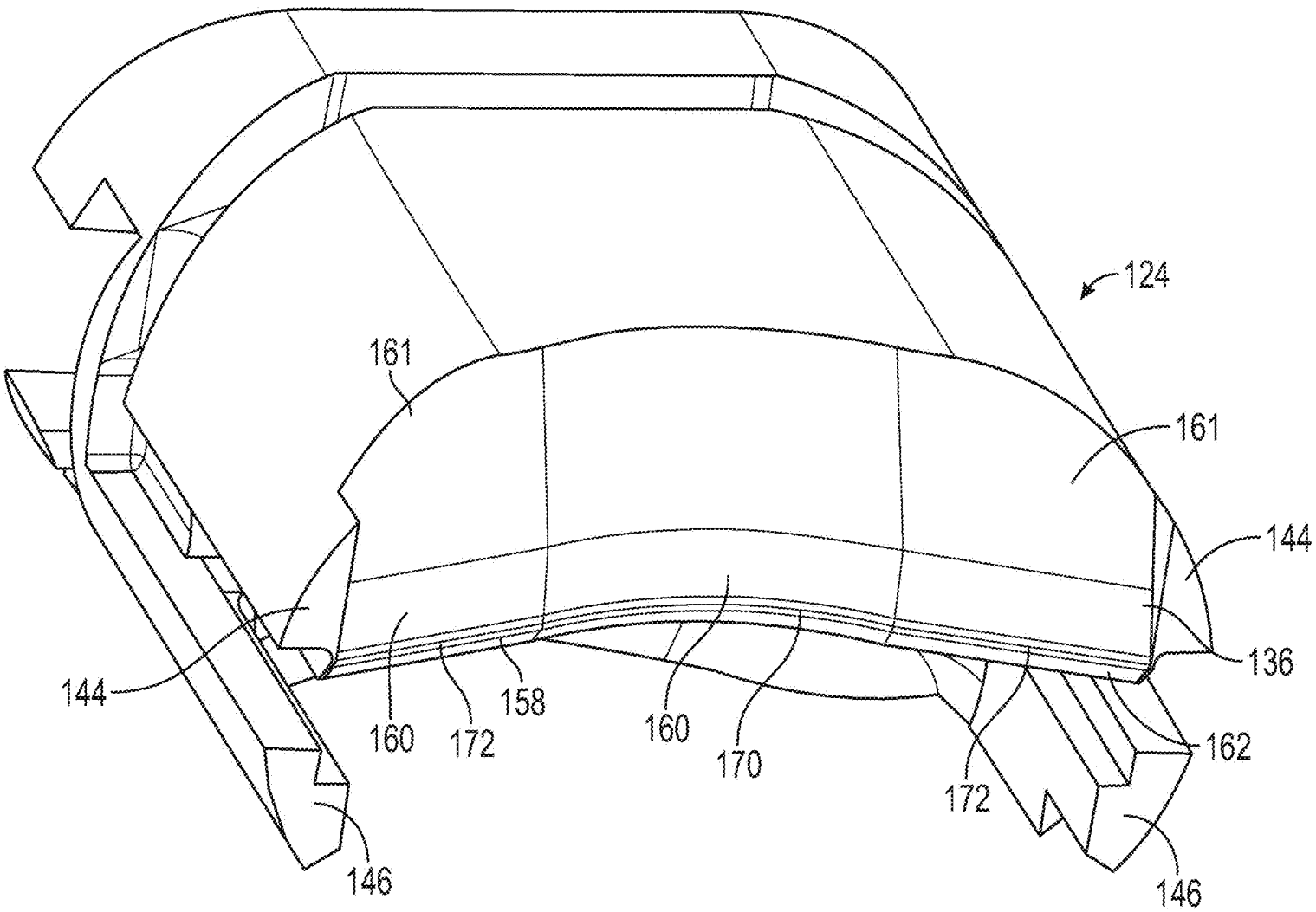
FIG. 8A shows a top perspective view of a first ram.
Figure 8B:
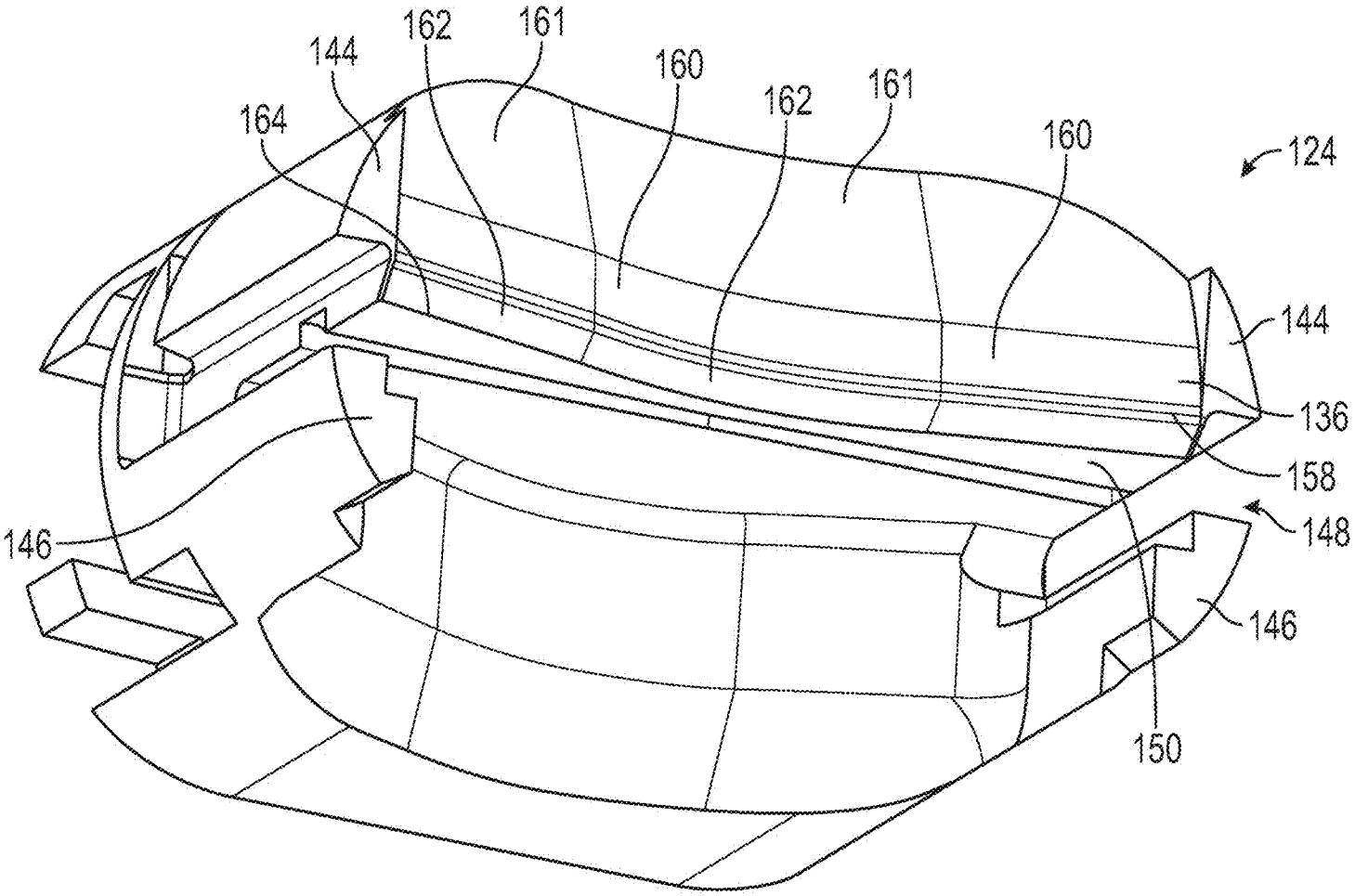
FIG. 8B illustrates a bottom perspective view of the first ram shown in FIG. 8A.

Referring to FIGS. 8A and 8B, top and bottom perspective views of an embodiment of a first ram 124 are shown. The first ram 124 comprises a first upper blade 136 having a blunt leading contour 158 that extends between the upper guides 144 at the front of the blade 136. The first upper blade 136 has upper primary inclined surfaces 160 extending from the blunt leading contour 158 to upper secondary inclined surfaces 161. At the leading most portions of the bottom side 150, the blade 136 has a cutting edge 164. The first upper blade 136 also has lower inclined surfaces 162 extending from the blunt leading contour 158 to the cutting edge 164. The cutting edge 164 is a very short substantially vertical front side of the blade 136 that meets the bottom side 150. The first upper blade 136 also has lower declined surfaces 162 extending from the blunt leading contour 158 to the cutting edge 164. In the middle of the blunt leading contour 158, the first upper blade 136 has a concave arc 170 and the left and right sides have forward angled sections 172.

Figure 8C:
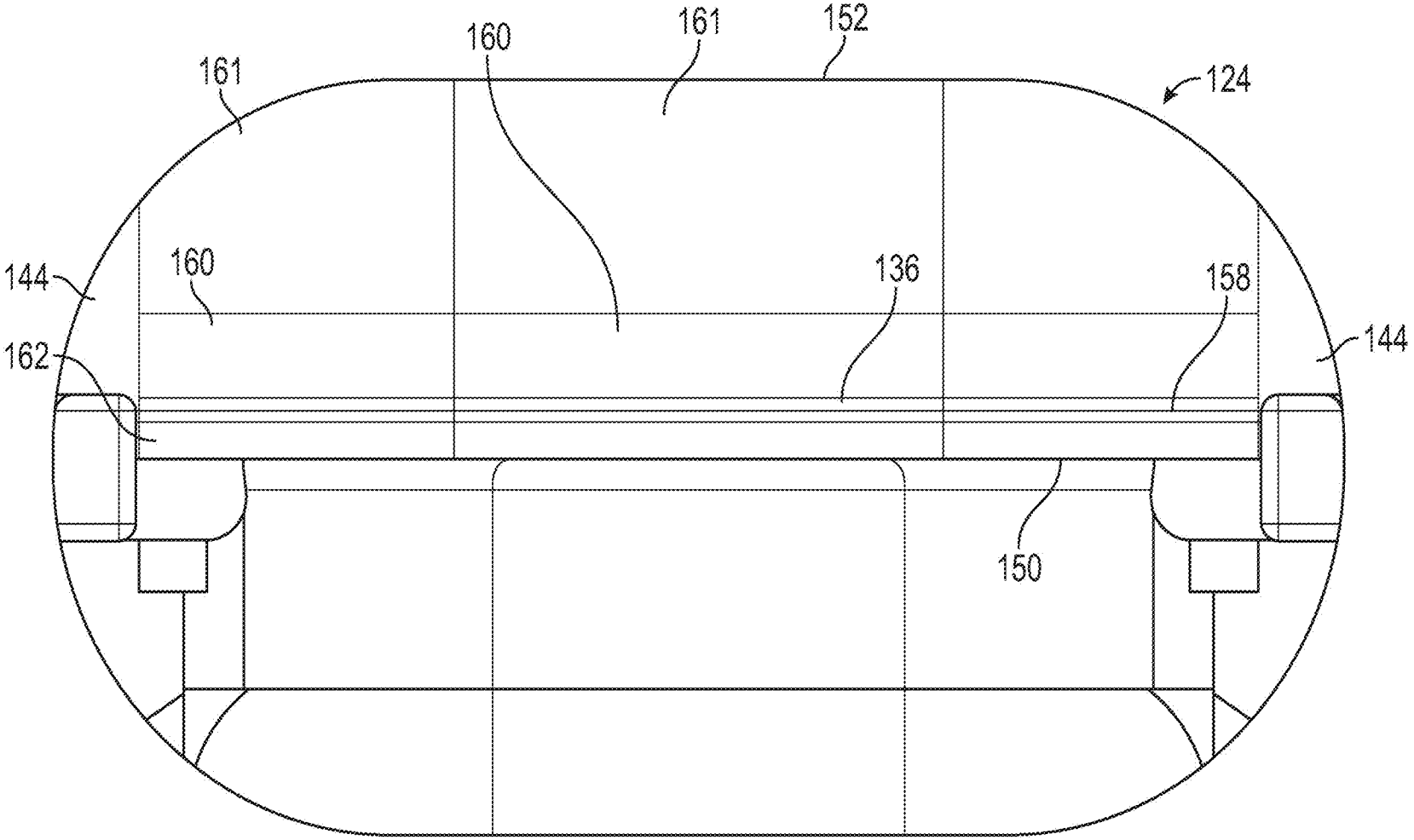
FIG. 8C shows a front view of the first ram shown in FIGS. 8A-8B.

FIG. 8C shows a front view of the first ram 124. As clearly shown in this view, the first upper blade 136 is flat and horizontal on its bottom side 150. The top side 152 of the first upper blade 136 is also flat and horizontal so as to fit within a guideway 20. The blunt leading contour 158 extends between the upper guides 144 at the front of the blade 136.

Figure 8D:
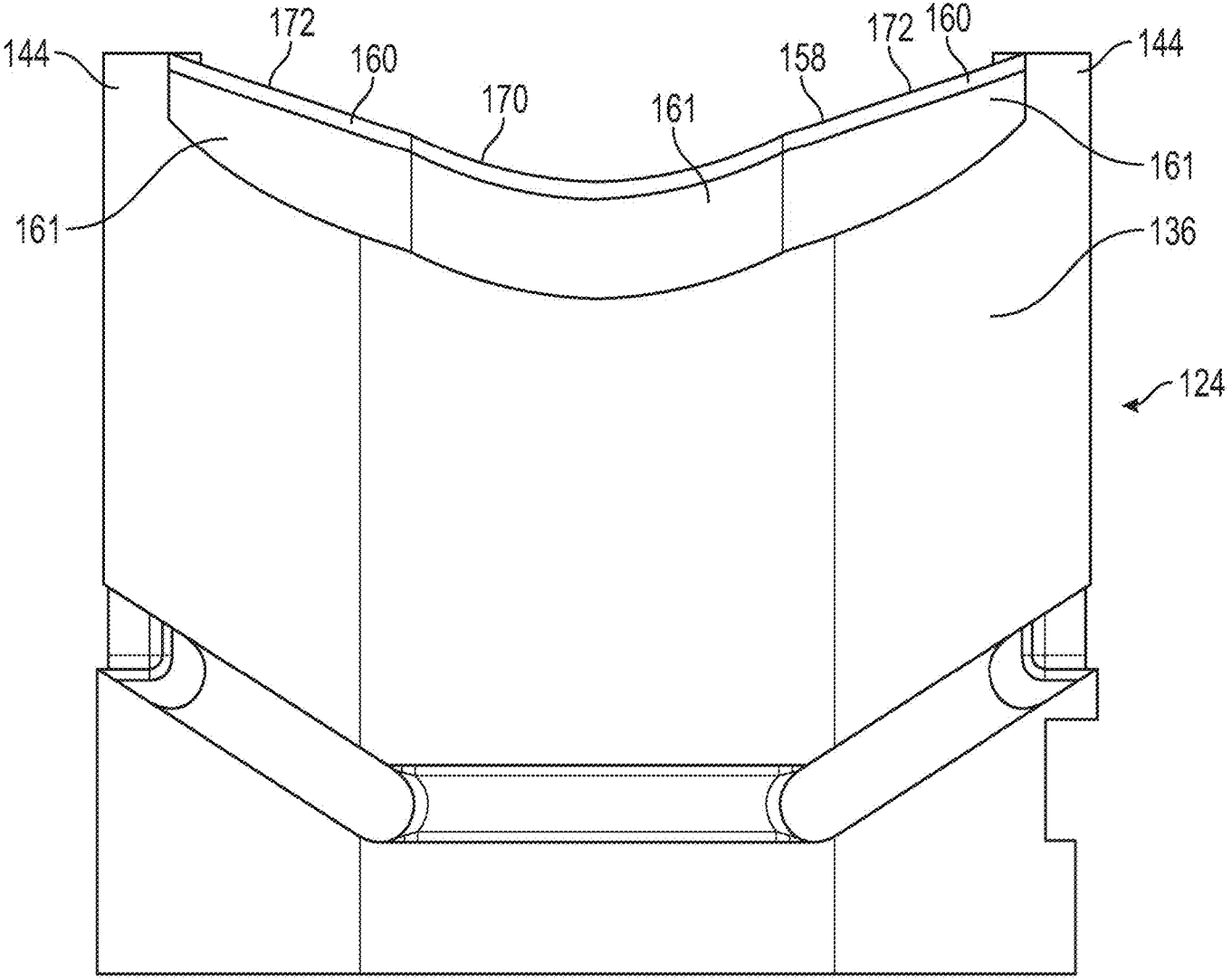
FIG. 8D illustrates a top view of the first ram shown in FIGS. 8A-8C.

FIG. 8D shows a top view of the first ram 124. In this view, the profile of the blunt leading contour 158 is shown extending between the upper guides 44. In the middle of the blunt leading contour 158, the first upper blade 136 has a concave arc 170 and the left and right sides have forward angled sections 172. The first upper blade 136 has upper primary inclined surfaces 160 extending from the blunt leading contour 158 to upper secondary inclined surfaces 161. In one embodiment, the inclination angle of the upper primary inclined surfaces 160 of the first upper blade 136 may be about 75 degrees from horizontal and the inclination angle of the upper secondary inclined surfaces 161 of the first upper blade 136 may be about 60 degrees from horizontal. (See FIG. 8C).

Figure 8E:
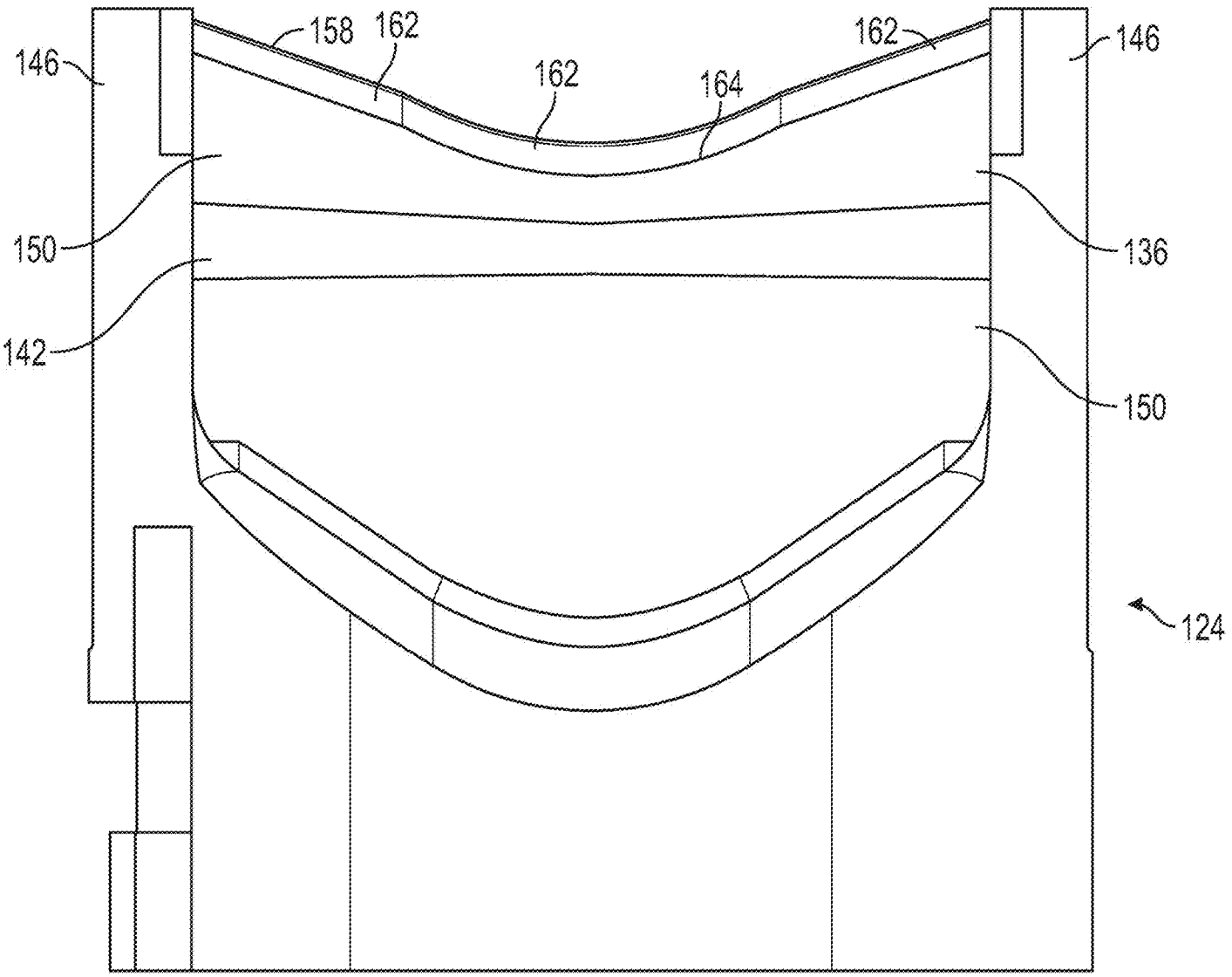
FIG. 8E shows a bottom view of the first ram shown in FIGS. 8A-8D.

Referring to FIG. 8E, a bottom view is shown of the embodiment of the first ram 124 of FIGS. 8A-8D. In this view, the bottom side of the first upper blade 136 is visible between the lower guides 146. A seal channel 142 is located in the bottom side 150. A seal may be positioned in the seal channel 142 for sealing engagement between the first upper blade 136 and the second lower blade 138 (see FIG. 2) when the rams are closed. The profile of the blunt leading contour 158 is also visible in FIG. 8E. Further, from this perspective, the cutting edge 164 is also visible. The cutting edge 164 has a profile similar to the blunt leading contour 158. Lower decline surfaces 162 extend between the blunt leading contour 158 and the cutting edge 164.

Figure 8F:
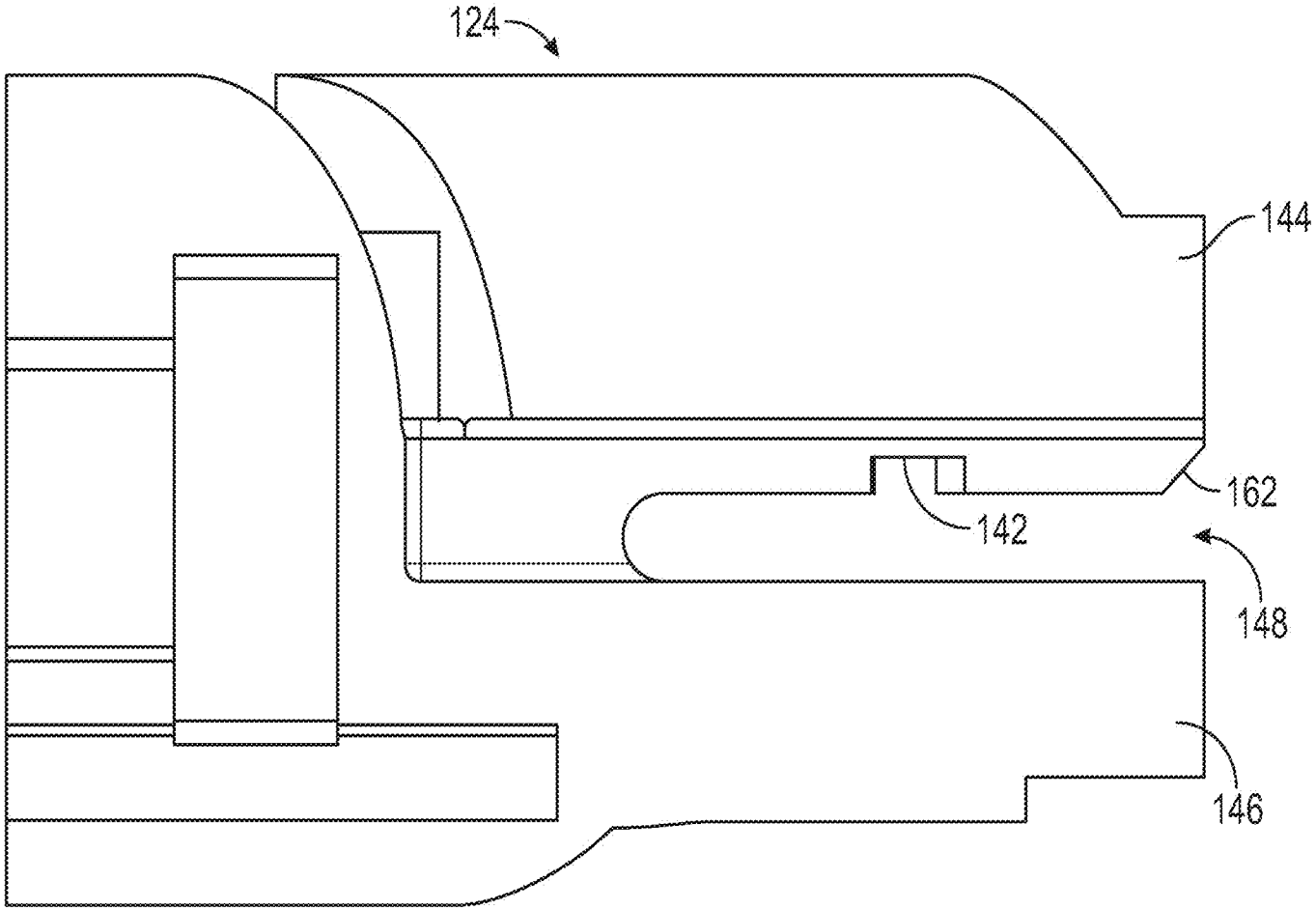
FIG. 8F shows a side view of the first ram shown in FIGS. 8A-8E.

FIG. 8F shows a right side view of the first ram 124. An upper guide 144 is at the top of the first ram 124 and a lower guide 146 is at the bottom of the first ram 124. A guide channel 148 is bounded between the upper and lower guides 144 and 146. In this view, the depth and width of the seal channel 142 are clearly visible. In one embodiment, the declination angle of the lower declined surfaces 162 of the first upper blade 136 may be about 45 degrees from horizontal. (See FIG. 8C).

Figure 9A:
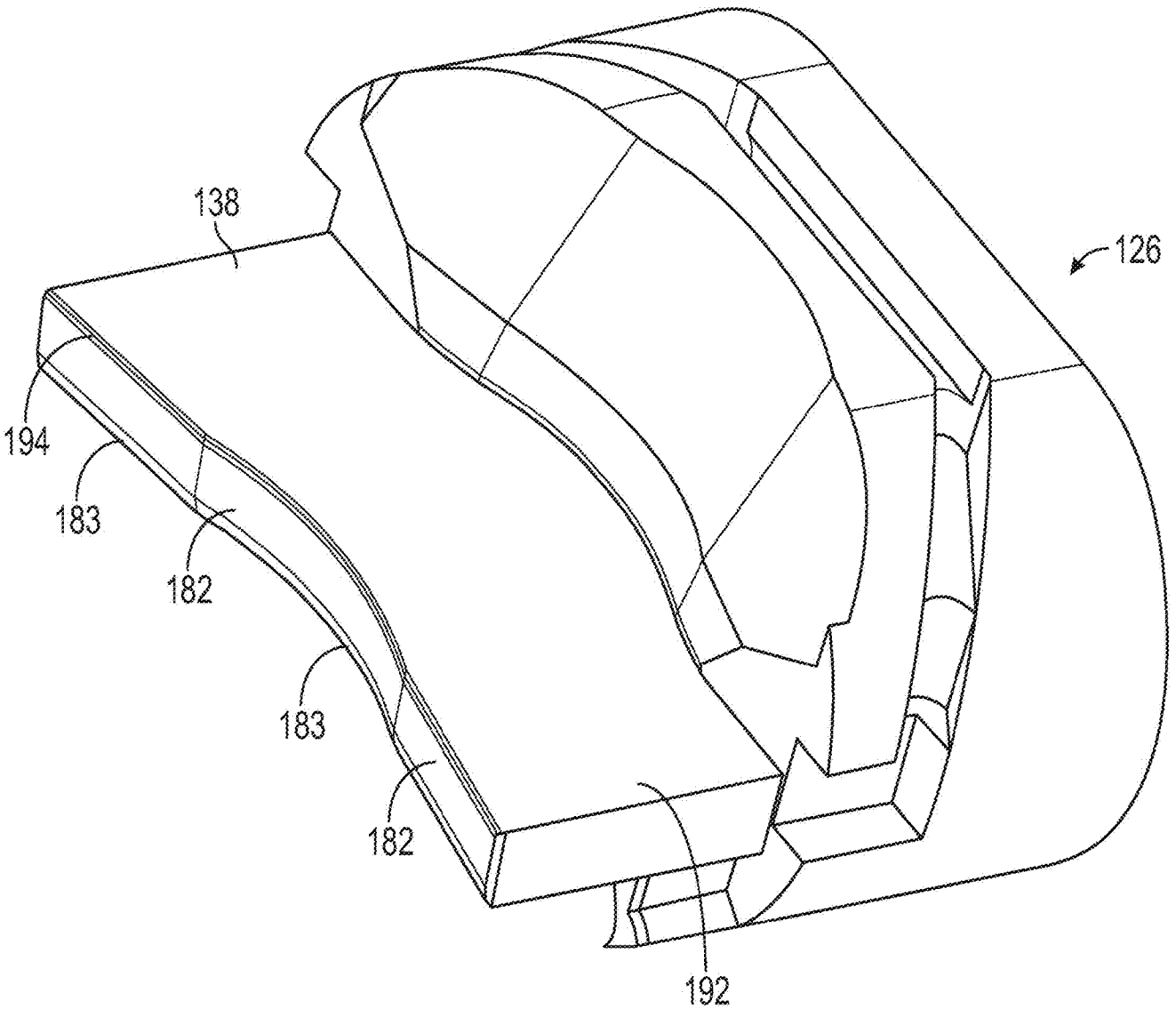
FIG. 9A shows a top perspective view of a second ram.
Figure 9B:
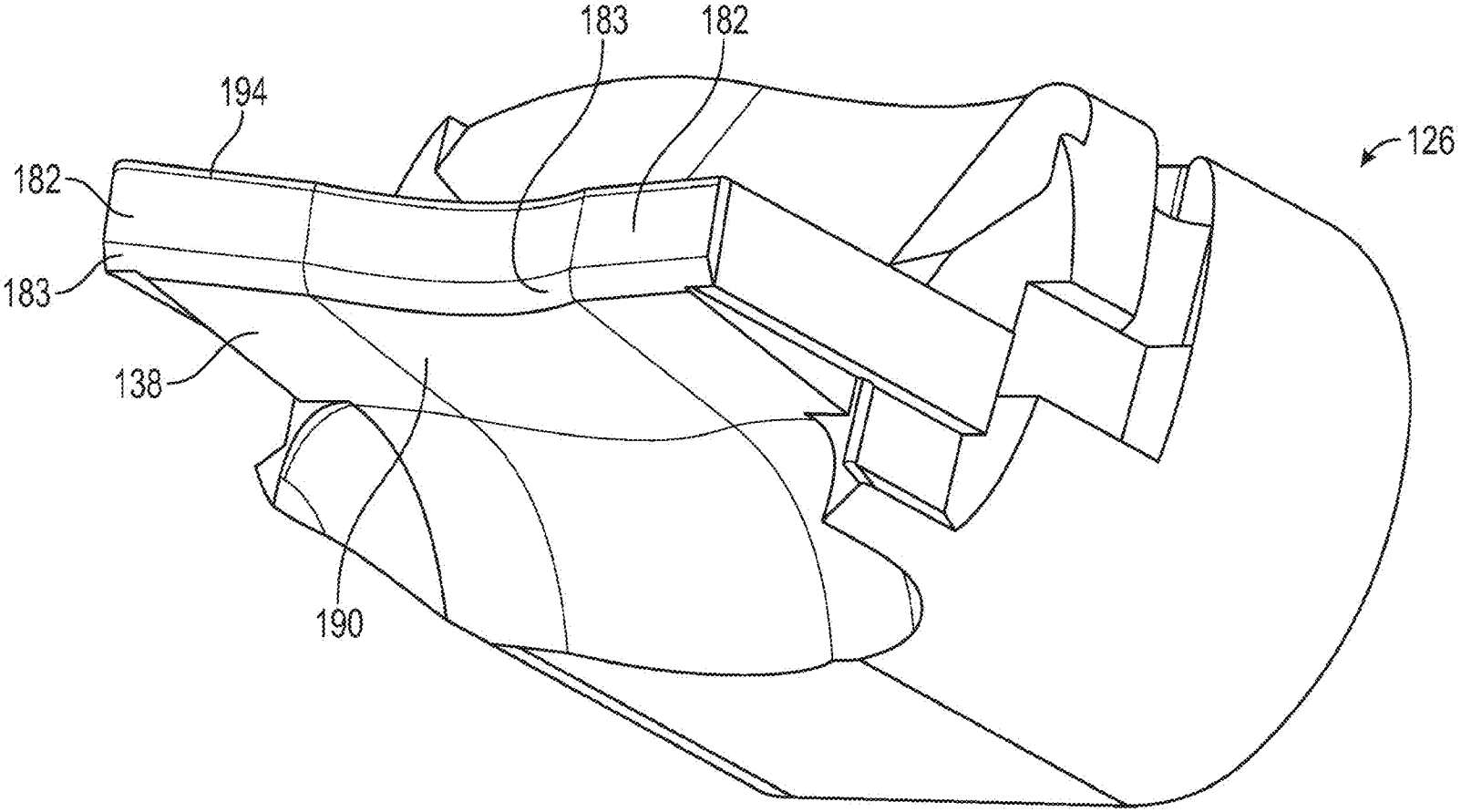
FIG. 9B illustrates a bottom perspective view of the second ram shown in FIG. 9A.

Referring to FIGS. 9A and 9B, top and bottom perspective views of an embodiment of a second ram 126 are shown. The second ram 126 comprises a second lower blade 138 having a top side 192, and a bottom side 190. At the leading most portions of the top side 192, the blade 138 has a cutting edge 194. The cutting edge 194 is a very short substantially vertical front side of the blade 138 that meets the top side 192 at a substantially 90 degree corner. The second lower blade 138 has lower primary declined surfaces 182 extending from the cutting edge 194 to lower secondary declined surfaces 183, which extend to the bottom side 190.

Figure 9C:
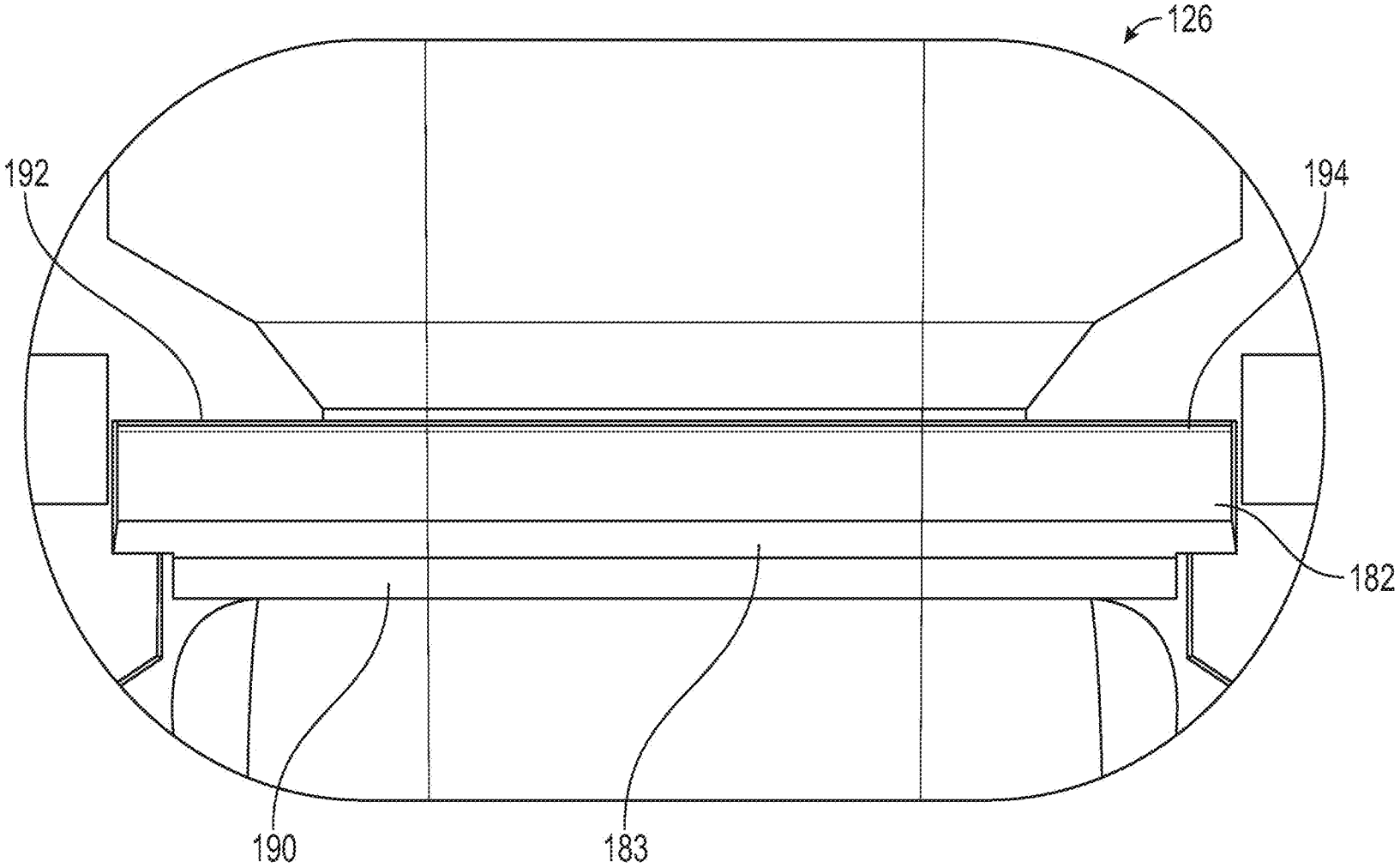
FIG. 9C shows a front view of the second ram shown in FIGS. 9A-9B.

FIG. 9C shows a front view of the second ram 126. The top side 192 is substantially flat and horizontal. The bottom side 190 is also substantially flat, but it is slightly declined from its leading end toward its trailing end.

Figure 9D:
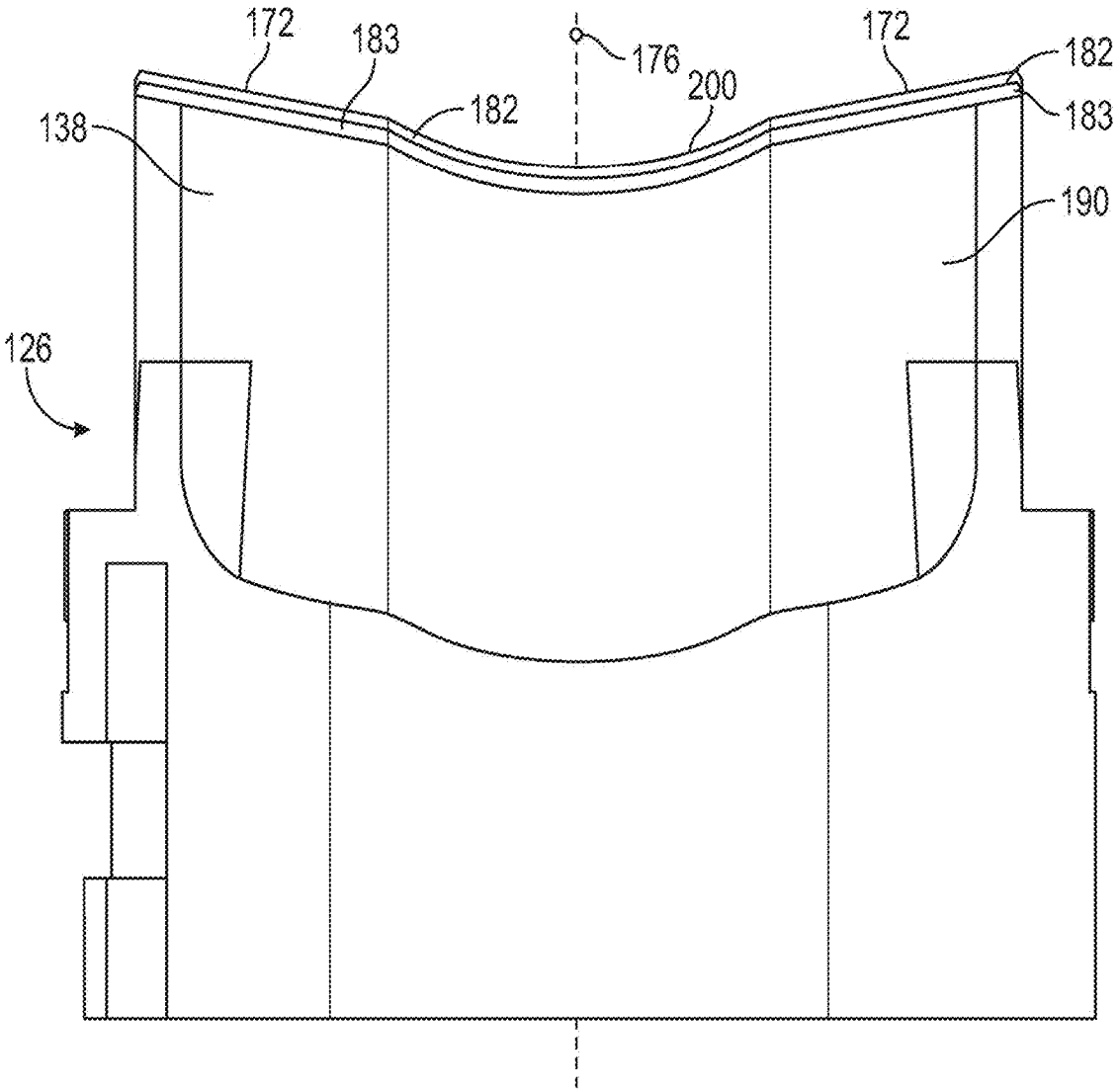
FIG. 9D illustrates a bottom view of the second ram shown in FIGS. 9A-9C.

FIG. 9D shows a bottom view of the second ram 126. In this view, the profile of the cutting edge 194 is shown at the leading portion of the second lower blade 138. The cutting edge 194 is symmetrical about the centerline 176. A concave arc 200 is at the mid-section and a forward angled section 172 is on each side. The concave arc 200 merges into the forward angled sections 172. The concave arc 200 has a radius about 50% the width of the second lower blade 138. The forward angled sections 172 sweep forwardly at an angle of about 80 degrees from the centerline 76.

Figure 9E:
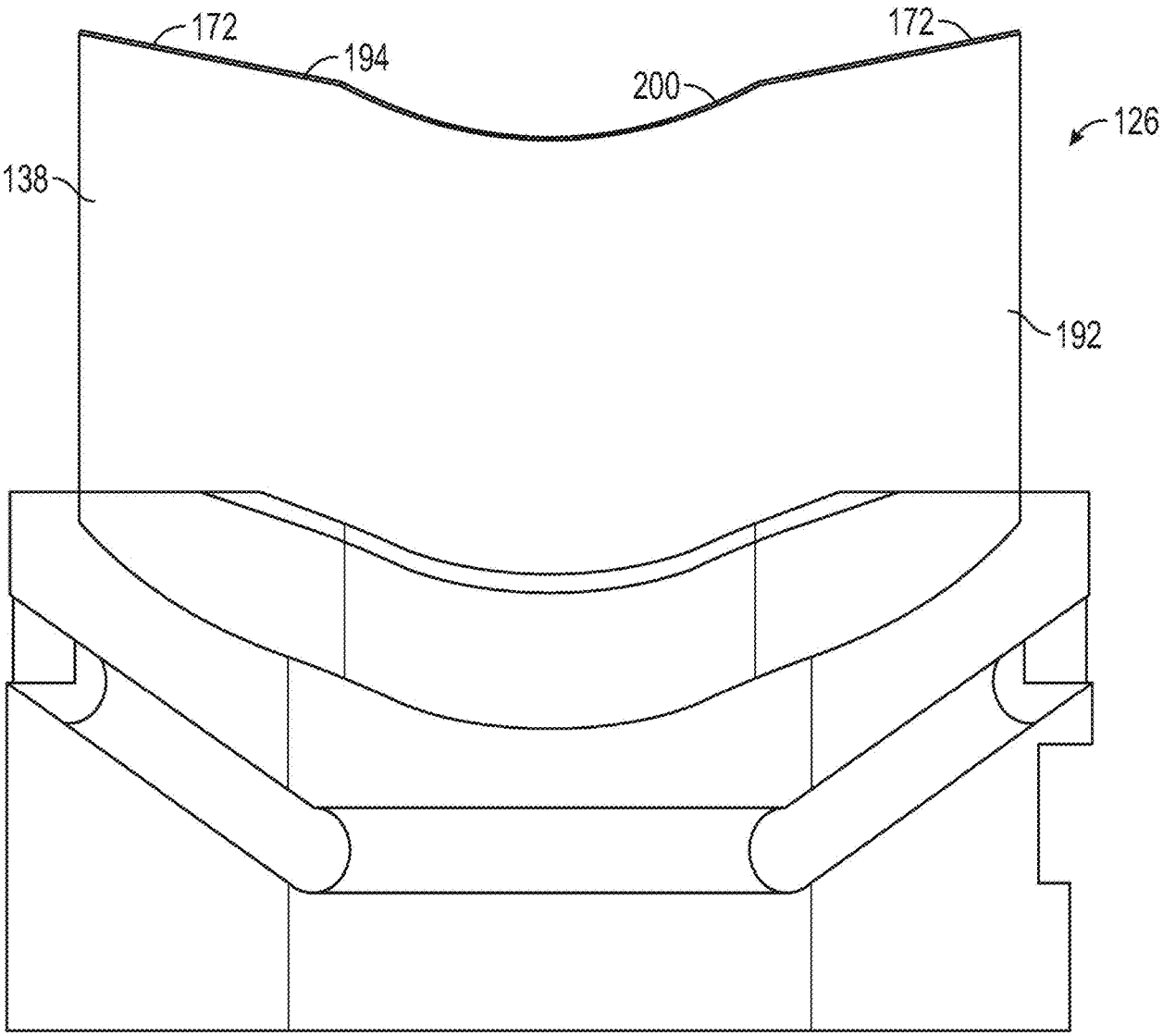
FIG. 9E shows a top view of the second ram shown in FIGS. 9A-9D.

Referring to FIG. 9E, a top view is shown of the embodiment of the second ram 126 of FIGS. 9A-9D. In this view, the top side 192 of the second lower blade 138 is visible. The profile of the cutting edge 194 is also visible in FIG. 9E.

Figure 9F:
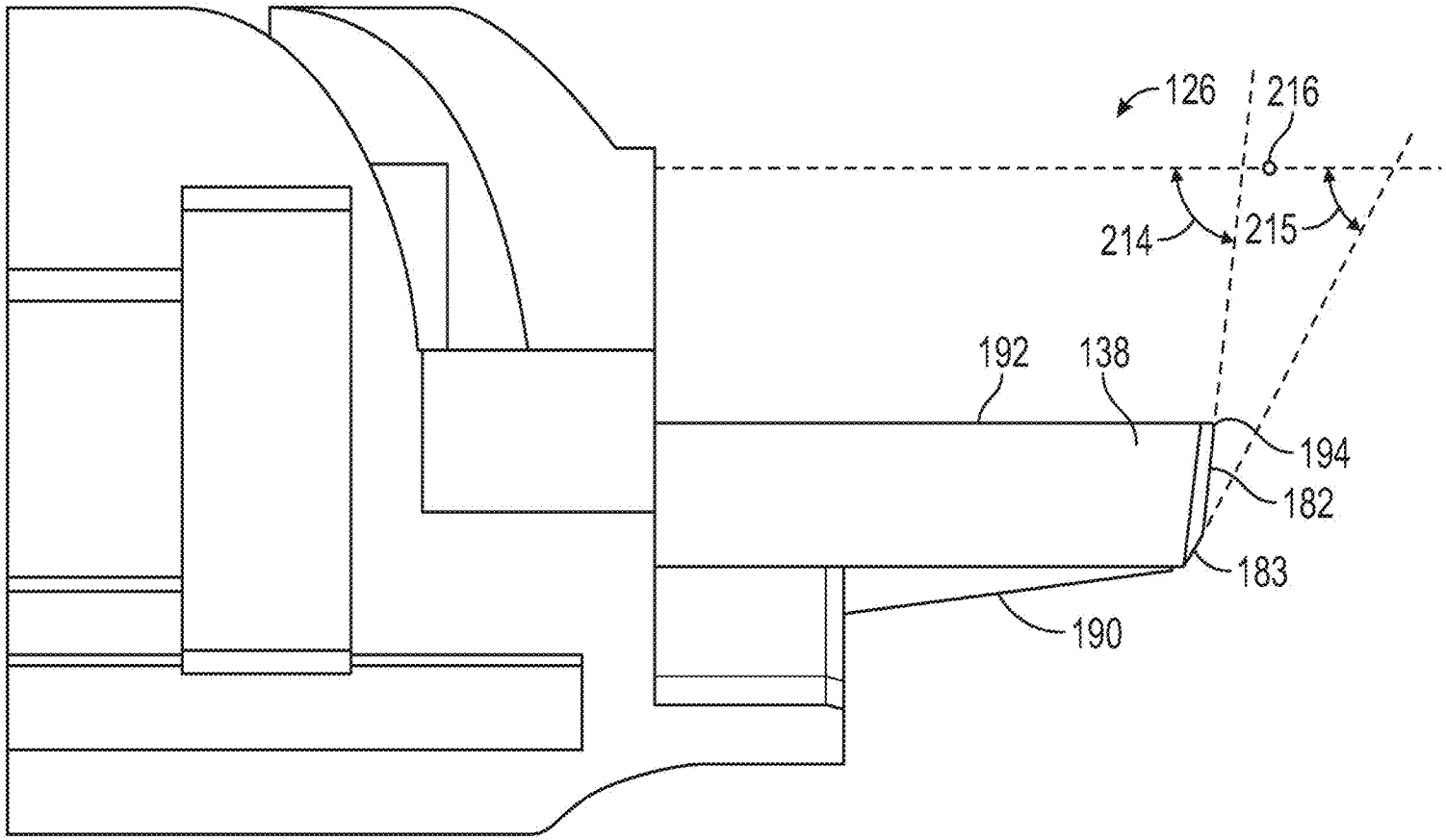
FIG. 9F shows a side view of the second ram shown in FIGS. 9A-9E.

FIG. 9F shows a left side view of the second ram 126. The cutting edge 194 is located at the distal end of the second lower blade 138. The top side 192 is opposite the bottom side 190. A lower primary declined surface 182 extends between the cutting edge 194 and a secondary declined surface 183, which extends to a bottom side 190 of the blade 138. In this embodiment, the lower primary declined surface 182 has a declination angle 214 of about 83 degrees from horizontal 216. In this embodiment, the lower secondary declined surface 183 has a declination angle 215 of about 60 degrees from horizontal 216.

Figure 10A:
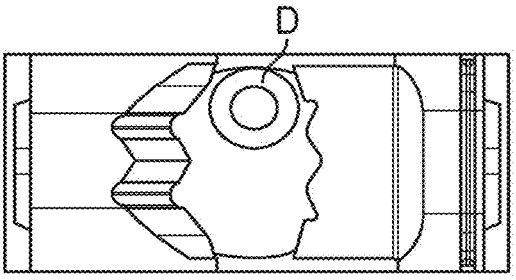
FIGS. 10A-10E are top views of first and second rams with a tubular in various positions between the ram blades.
Figure 10B:
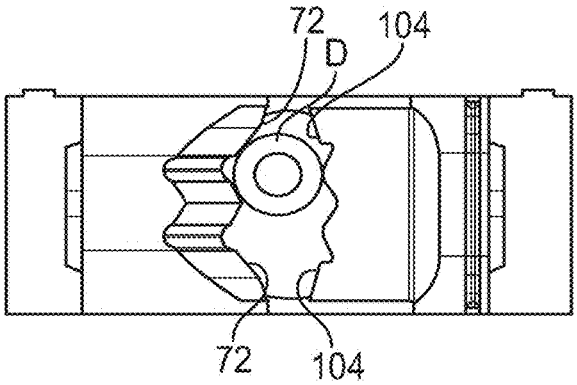
Figure 10C:
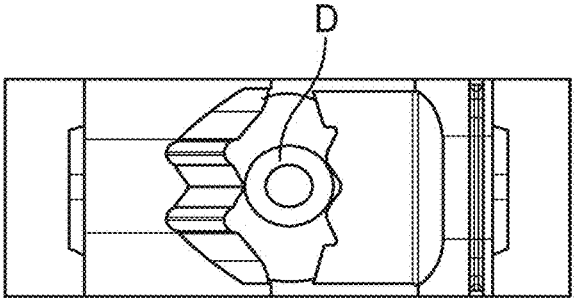
Figure 10D:
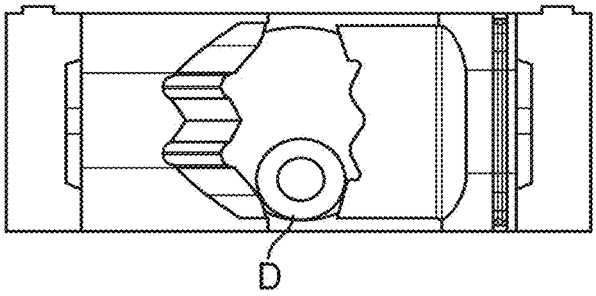
Figure 10E:
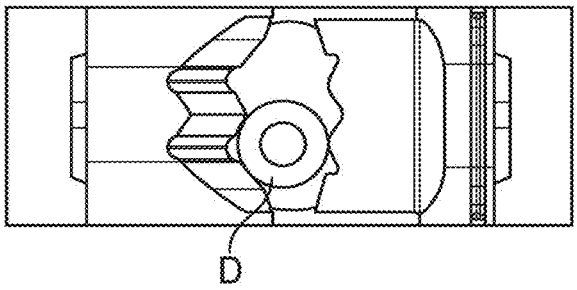

As represented on FIGS. 10A through 10E, in embodiments of the disclosure, the forward angled sections 72 of the first upper blade 36 and the forward angled sections 104 of the second lower blade 38 are such that the resulting blade geometries can induce or drive motion on the drill pipe or tubular D, pushing it into a position designed to impart maximum force onto such tubular. The design of the rams are not intended to centralize the pipe or tubular D with the rams' central axis, but rather induce motion of the pipe or tubular D into one of a plurality (here shown are three different) of locations designed to impart maximum load onto the tubular in order to successfully shear or rip it. In embodiments, the forward angled sections and other portions of the profiles are designed in such a manner that the pipe or tubular D will be pushed into one of these locations regardless of its original starting position. In embodiments as shown on FIGS. 10A and 10B, the pipe is excentered on a far side of the rams (FIG. 10A) and the profiles of the leading contours of the blades enables, when the rams are moved towards a closed position, the pipe or tubular D to be driven to the preferred immediately following location (FIG. 10B) where optimum shearing or ripping can occur. Similarly, as shown on FIG. 10D, the pipe is excentered on the other far side of the ram (FIG. 10D) and the profiles of the leading contours of the blades of the rams enable, when the rams are moved towards a closed position, the pipe or tubular D to be driven to the preferred immediately following location (FIG. 10E) where optimum shearing or ripping can occur. In FIG. 10C, the pipe or tubular D is shown in a location appropriate for optimum shearing or ripping, and thus, the profiles of the leading contours of the blades do not induce movement of the pipe or tubular D when rams are closing.

Although the disclosed embodiments are described in detail in the present disclosure, it should be understood that various changes, substitutions and alterations can be made to the embodiments without departing from their spirit and scope.

INDUSTRIAL APPLICABILITY

Blowout preventer systems and methods of the present invention have many industrial applications including but not limited to preventing blowouts in drilled well bores for the oil and gas industry.

What is claimed is:

1. A blowout preventer for shearing, cutting, ripping, or tearing a structure positioned in a bore extending through the blowout preventer, the blowout preventer comprising:

a body having a bore, a first guideway, and a second guideway;

a first ram movably positioned relative to the first guideway and movable toward the bore, the first ram comprising a first blade, the first blade comprising:

at least one flat side;

a first blunt leading contour running parallel to a plane of the at least one flat side along a distal end of the first blade;

at least one upper inclined surface above the first blunt leading contour; and at least one lower declined surface below the first blunt leading contour, wherein the first blade is positioned and is movable above a first plane;

a second ram movably positioned relative to the second guideway and movable toward the bore, the second ram comprising a second blade, the second blade comprising:

a second blunt leading contour; and at least one lower declined surface, wherein the second blade is positioned and is movable below the first plane.

2. The blowout preventer as claimed in claim 1, wherein the first blunt leading contour and the second blunt leading contour are vertically offset from each other by an offset distance.

3. The blowout preventer as claimed in claim 1, wherein the first blunt leading contour is disposed on and movable in a second plane, wherein the first plane, the second plane, and the plane of the at least one flat side of the first blade are parallel, and wherein the at least one lower declined surface of the first blade is between the first and second planes.

4. The blowout preventer as claimed in claim 3, wherein the second blunt leading contour comprises at least one upper inclined surface above the second blunt leading contour, wherein the second blunt leading contour is movable in a third plane, the first and third planes are parallel, and the at least one upper inclined surface of the second blade is between the first and third planes.

5. The blowout preventer as claimed in claim 1, wherein the first blade further comprises a first cutting edge below the at least one lower declined surface, and wherein the second blade further comprises a second cutting edge.

6. The blowout preventer as claimed in claim 1, wherein the first blunt leading contour comprises a profile having at least one point.

7. The blowout preventer as claimed in claim 1, wherein the second blunt leading contour comprises a profile having at least two points.

8. The blowout preventer as claimed in claim 1, wherein the first blunt leading contour comprises a profile having at least one point, wherein the second blunt leading contour comprises a profile having at least two points.

9. The blowout preventer as claimed in claim 1, wherein the first blunt leading contour comprises a profile having at least two concave arcs, and wherein the second blunt leading contour comprises a profile having at least one concave arc.

10. The blowout preventer as claimed in claim 9, wherein each of the at least two concave arcs of the first blunt leading contour merges into a first forward angled section, and wherein the at least one concave arc of the second blunt leading contour merges into a second forward angled section.

11. The blowout preventer as claimed in claim 2, wherein the first blade further comprises a first cutting edge below the at least one lower declined surface, wherein the second blade further comprises a second cutting edge, and wherein the structure is a wireline.

12. A blowout preventer for shearing, cutting, ripping, or tearing a structure positioned in a bore extending through the blowout preventer, the blowout preventer comprising:

a body having a bore, a first guideway, and a second guideway;

a first ram movably positioned relative to the first guideway and movable toward the bore, the first ram comprising a first blade, the first blade comprising:

at least one flat side;

a first blunt leading contour running parallel to a plane of the at least one flat side along a distal end of the first blade;

at least one upper inclined surface above the first blunt leading contour, wherein the at least one upper inclined surface forms an angle between about 120 and 160 degrees with the at least one flat side, and at least one lower declined surface below the first blunt leading contour, wherein the at least one lower declined surface forms an angle between about 60 and 100 degrees with the at least one upper inclined surface;

a second ram movably positioned relative to the second guideway and movable toward the bore, the second ram comprising a second blade, the second blade comprising:

at least one flat side;

a second blunt leading contour; and at least one lower declined surface, wherein the first blunt leading contour and the second blunt leading contour are vertically offset from each other by an offset distance.

13. The blowout preventer as claimed in claim 12, wherein the second blade further comprises at least one upper inclined surface above the second blunt leading contour, wherein the at least one upper inclined surface forms an angle between about 120 and 160 degrees with the flat side, and wherein the at least one lower declined surface of the second blade forms an angle between about 60 and 100 degrees with the at least one upper inclined surface of the second blade.

14. The blowout preventer as claimed in claim 12, wherein the first blade further comprises a first cutting edge below the at least one lower declined surface, and wherein the second blade further comprises a second cutting edge.

15. The blowout preventer as claimed in claim 12, wherein the first blunt leading contour comprises a profile having at least one point and flanks on opposite sides of the at least one point, wherein the flanks form an angle of about 110 to 150 degrees at the at least one point, wherein the second blunt leading contour comprises a profile having at least two points.

* * * * *